United States Patent [19]

Yamamoto et al.

[11] Patent Number: 5,055,815

[45] Date of Patent: Oct. 8, 1991

[54] STATIONARY INDUCTION ELECTRIC APPARATUS

[75] Inventors: Yasuo Yamamoto; Katsumi Hanaoka; Masatake Hirai; Toshiko Yamada, all of Osaka, Japan

[73] Assignee: Daihen Corporation, Osaka, Japan

[21] Appl. No.: 403,668

[22] Filed: Sep. 6, 1989

[30] Foreign Application Priority Data

Apr. 6, 1989 [JP] Japan ..... 1-87816

[51] Int. Cl.[5] ..... H01F 27/26; H01F 27/30

[52] U.S. Cl. ..... 336/196; 336/210; 336/213; 336/217; 336/234

[58] Field of Search ..... 336/210, 212, 213, 234, 336/196, 216, 217; 29/606, 609

[56] References Cited

U.S. PATENT DOCUMENTS

| | | | |
|---|---|---|---|
| 4,599,594 | 7/1986 | Siman | 336/213 X |
| 4,646,048 | 2/1987 | Hunt et al. | 336/213 |
| 4,663,605 | 5/1987 | Lee | 336/210 X |
| 4,673,907 | 6/1987 | Lee | 336/210 X |
| 4,707,678 | 11/1987 | Siman | 336/212 |
| 4,723,349 | 2/1988 | Grimes | 336/210 X |
| 4,734,975 | 4/1988 | Ballard et al. | 336/234 X |
| 4,741,096 | 5/1988 | Lee et al. | 336/213 X |
| 4,761,630 | 8/1988 | Grimes et al. | 336/213 |
| 4,766,407 | 8/1988 | Grimes | 336/196 |
| 4,789,849 | 12/1988 | Ballard et al. | 336/210 |
| 4,893,400 | 1/1990 | Chenoweth | 336/234 X |

FOREIGN PATENT DOCUMENTS

| | | |
|---|---|---|
| 63-15023 | 2/1988 | Japan . |
| 63-12045 | 5/1988 | Japan . |
| 64-50511 | 2/1989 | Japan . |
| 64-68912 | 3/1989 | Japan . |

*Primary Examiner*—Thomas J. Kozma

*Attorney, Agent, or Firm*—Scully, Scott, Murphy & Presser

[57] ABSTRACT

A stationary induction electric apparatus and a method for manufacturing the apparatus is disclosed. The apparatus comprises a reinforcement frame to be mounted on an inner peripheral surface of a rectangular core, a protective cover for covering both of the rectangular core and the reinforcement frame, a reinforcement band to be wound on an outer peripheral surface of the rectangular core on which the protective cover is mounted, and windings to be fitted on the leg portion of the rectangular core on which the reinforcement frame, the protective cover, and the reinforcement band are mounted.

3 Claims, 17 Drawing Sheets

Rf2
Rf2c
Rf1c
Rf1c
Rf1

Rf2
Rf2b
Rf1b
Rf1

Rf2
Rf
Rf1a
Rf1
e
Rf1a

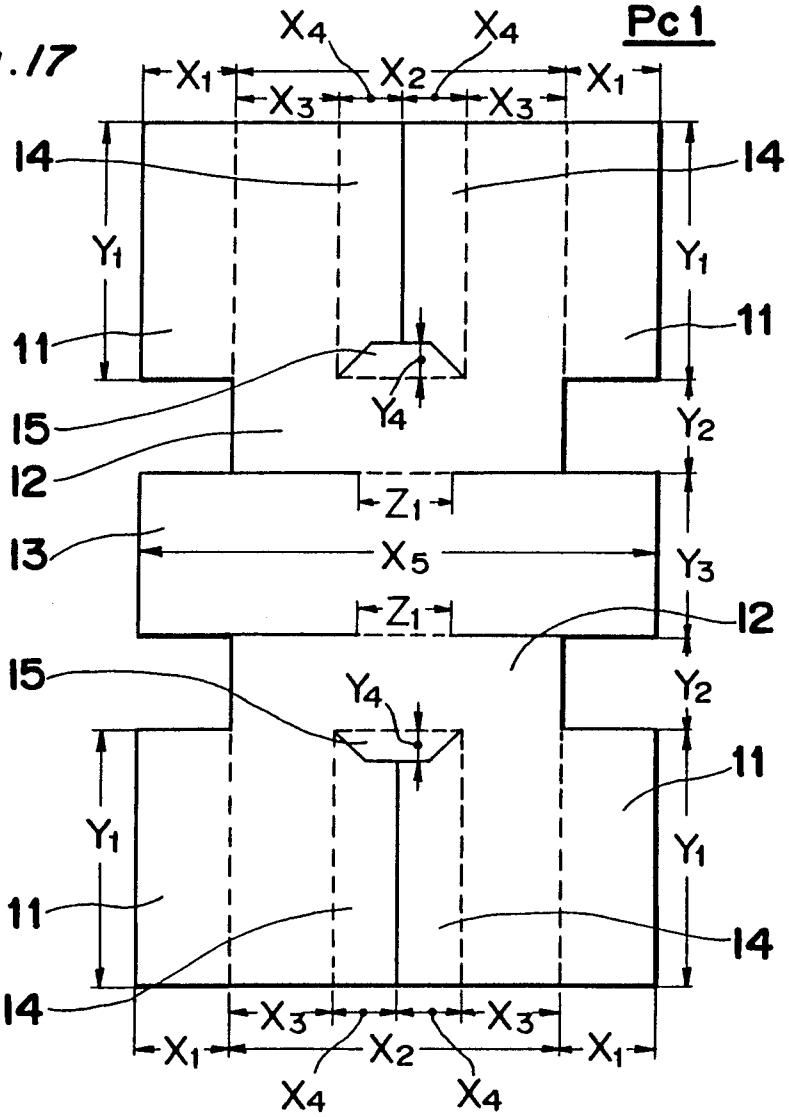
Fig. 17
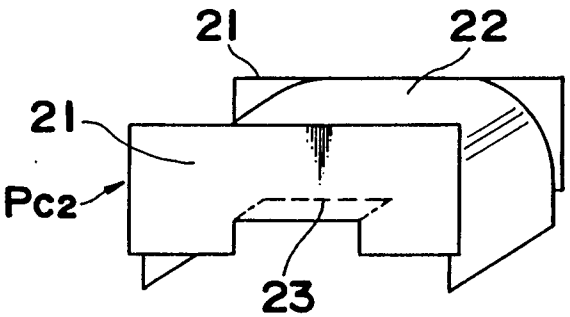
Fig. 16
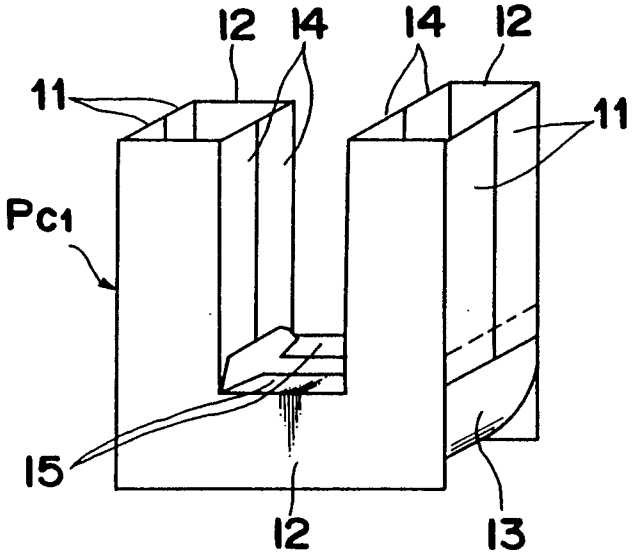

STATIONARY INDUCTION ELECTRIC APPARATUS

BACKGROUND OF THE INVENTION

1. Field of the Invention

The present invention relates to a stationary induction electric apparatus such as a transformer, an inductive reactance device, which is constituted by fitting windings around a transformer core wound from stripes of an amorphous magnetic alloy, and a method for manufacturing the stationary induction electric apparatus.

2. Description of the Related Art

Recently, amorphous magnetic alloys are paid attention as core materials because of low magnetic loss, and methods for manufacturing distribution transformers using a strip of an amorphous magnetic alloy have been studied.

Conventionally, cores for distribution transformers are made using silicon iron strips. According to a conventional manufacturing method, laminations each of which is comprised of plural silicon iron strip elements having been cut so as to have a length slightly larger than that of one turn are prepared and bent into a rectangular configuration. Then, plural laminations are packaged into a lamination block by abutting the ends of each of laminations stepwise. Furthermore, plural lamination blocks are built into a core. This type of core is called a core of one turn cut.

Upon manufacturing the core of one turn cut type, a wound silicon iron strip is cut by a length slightly longer than that of one turn while unwinding the wound strip. The cut strip elements are wound successively so as to form a circular core by staggering the joint position thereof to that of the foregoing one. The core thus formed is shaped into a rectangular configuration, and thereafter, it is annealed. Then, the core is opened once to fit windings therearound, and thereafter, the core is closed by jointing respective joints to build into a transformer.

An applicability of this method for manufacturing cores using an amorphous magnetic strip was studied at first. However, the amorphous magnetic strip is difficult to handle with since it has a thickness of about 25 μms which demands a laborsome and inefficient cutting operation.

In order to solve these problems, there has been proposed a method, wherein lamination units are formed by laminating plural strip elements (ten to several tens elements), and a core is formed using plural lamination units. According to this method, plural lamination units are stacked, and the stacked units are wound to form a lamination block by over lapping both ends of each of the units shifted with each other in stair step fashion. Then, plural lamination blocks thus formed are built to a core having a predetermined thickness.

After the core stacked to have a predetermined thickness is shaped into a rectangular shape with positioning an overlapping joint portion on one side of a yoke portion, it is annealed in a magnetic field. This annealing in the magnetic field can recover the original magnetic characteristics from the state that it is lowered due to a strain caused in the process for manufacturing the core. Thereafter, the overlapping joint portion of the core is opened once, windings are inserted into the leg portion of the core, and the overlapping joint portion of the core is closed again. Then, the interlinkage connection between the magnetic circuit and the conductive circuit is completed, resulting in that the stationary induction electric apparatus has its fundamental functions such as a voltage transformer, an inductive reactance device.

When the lamination unit having a proper thickness comprised of stacked strips is handled as if it is a sheet of magnetic steel, the working efficiency can be improved. However, since the lamination unit is constituted only by overlapping the strips, the mechanical characteristic of the strips does not vary when the strips are constituted as a lamination unit. Therefore, the hardness of the lamination unit is relatively low since the strip is extremely thin, and it is difficult to handle it since the strip becomes easily breakable after it is annealed in the magnetic field. Therefore, upon assembling the stationary induction electric apparatus, a reinforcement member is required in order to hold the core mechanically so as to maintain the shape thereof when it has been completely shaped.

According to a method proposed in the Japanese utility model application No. 63-121106 by the present applicant, the inner and outer peripheral surfaces can be easily maintained in a predetermined shaped configuration, and pieces of strip can be prevented from being released from a portion covered by the reinforcement member.

Since the strip after being annealed in the magnetic field is easily breakable as described above, it is necessary to pay attention to the assembling process particularly upon inserting the windings into the core. However, even though the strip is handled carefully, the strip can not be prevented from being broken, and it is difficult to prevent the broken pieces thereof from generating. Further, it may be impossible to prevent the broken pieces from generating even after the stationary induction electric apparatus has been manufactured. In order to solve these problems, a method for preventing the broken pieces of strip from coming out by winding insulating sheets on the outer surface of the core has been proposed.

According to the above method proposed in the Japanese utility model application No. 63-18450 by the present applicant, the insulating sheets can be wound on the core efficiently, and the core can be mechanically held by the insulating sheets.

Therefore, in the stationary induction electric apparatus using the strips as the core, it is necessary to reinforce the apparatus mechanically in order to maintain the core in the predetermined shaped configuration and prevent a stress from being applied to the core, and also it is necessary to prevent the broken pieces of strip from generating. According to the method proposed in the Japanese utility model application No. 63-121106, the core can be protected mechanically, however, a procedure required for preventing a stress from being applied to the core and preventing the strip from being broken upon mounting the reinforcement member on the core is not disclosed in the above application.

According to the method proposed in the Japanese utility model application No. 63-18450, the insulating sheets can be wound on the core efficiently, however, the core can not be protected enough since the insulating sheets themselves have not a high hardness.

SUMMARY OF THE INVENTION

An essential object of the present invention is to provide a stationary induction electric apparatus capable of protecting a core mechanically against an outside force so as not to apply a stress to the core, and also preventing broken pieces of strip from generating.

Another object of the present invention is to provide a method for manufacturing a stationary induction electric apparatus capable of protecting a core mechanically against an outside force so as not to apply a stress to the core and also preventing broken pieces of strip from generating.

In order to achieve these objects, according to one aspect of the present invention, there is provided a stationary induction electric apparatus, wherein plural lamination blocks are formed respectively by laminating plural lamination units, each of which is formed by laminating a predetermined number of cut strips of an amorphous magnetic alloy, said plural lamination blocks are built up into a substantially rectangular wound core by piling them up and by jointing respective ends of individual lamination units of each lamination block in an overlapped state so as to position the joint portion thereof on one side of the rectangular wound core, one side having the joint portion and another opposing side are made as yoke portions respectively, and both two sides positioned between the yoke portions are made as leg portions respectively, said apparatus comprising:

a reinforcement frame to be mounted on the inner peripheral surface of said rectangular core;

a protective cover for covering both said rectangular core and said reinforcement frame, said protective core made of an insulating material;

a reinforcement band to be wound around the outer peripheral surface of said rectangular core on which said protective cover is mounted so as to be fixed; and windings to be fitted around the leg portions of said rectangular core on which said reinforcement frame, said protective cover and said reinforcement band are mounted.

According to another aspect of the present invention, there is provided a method for manufacturing a stationary induction electric apparatus comprising:

a jointing step for forming plural lamination blocks respectively by laminating plural lamination units, each of which being formed by laminating a predetermined number of cut strips of an amorphous magnetic alloy, and building up said plural lamination blocks into a substantially circular wound core by winding them around a bobbin and by jointing respective ends of individual lamination units of each lamination block in an overlapped state;

a core shaping step for inserting a rectangular shaping tool inside of said circular core and pressing said circular core from the outside thereof so as to shape said circular core into a rectangular configuration having one side facing the joint portion of both ends of said respective lamination blocks;

an annealing step for annealing said rectangular core; and a windings fitting step for fitting windings onto said rectangular core after said annealing process;

said method being characterized by the following steps;

a first reinforcement frame mounting step for mounting a first reinforcement frame for covering the inner peripheral surfaces of three sides of said rectangular core other than one side having the joint portion;

a first protective cover mounting step for mounting a first protective cover made of an insulating material for covering three sides of said rectangular core on which said first reinforcement frame is mounted:

a windings fitting step for fitting opening the joint portion once and windings onto the leg portions of said rectangular core;

a second reinforcement frame mounting step for inserting a second reinforcement frame for covering the inner peripheral surface of one side of the rectangular core having the joint portion, into the window portion of the opened joint portion, and jointing the end portion of said second reinforcement frame with the end portion of said first reinforcement frame;

a step for closing the opened joint portion again so as to form a side having joint portion on which said second reinforcement frame is mounted;

a second protective cover portion mounting step for mounting a second protective cover portion made of an insulating material for covering the side having the joint portion on which said second reinforcement frame is mounted; and a reinforcement band mounting step for winding a reinforcement band onto the outer peripheral surface of said rectangular core on which said first and second protective cover portions are mounted, so as to fix it.

BRIEF DESCRIPTION OF THE DRAWINGS

These and other objects and features of the present invention will become clear from the following description taken in conjunction with the preferred embodiment thereof with reference to the accompanying drawings, in which.

Figures 14A, 14B, 14C:
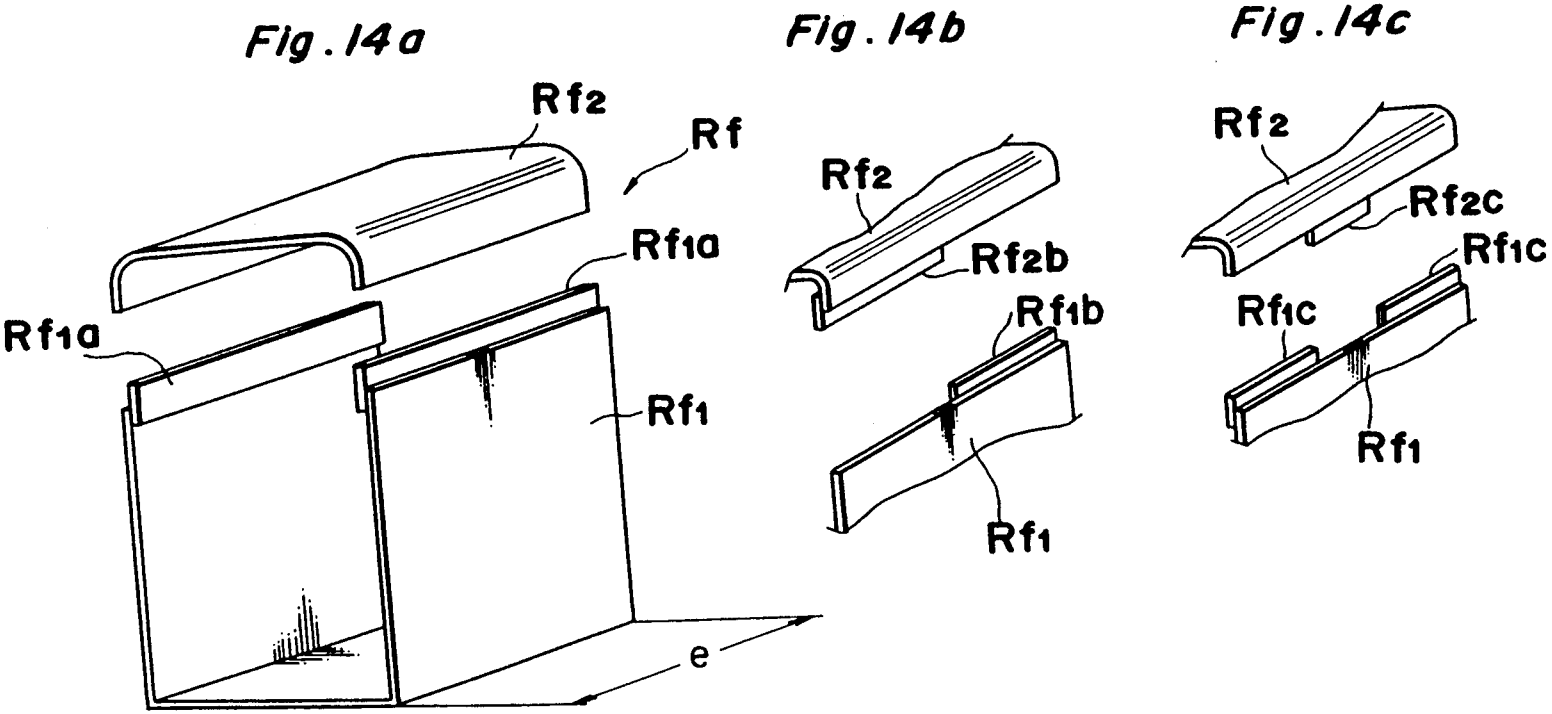
Figure 15A:
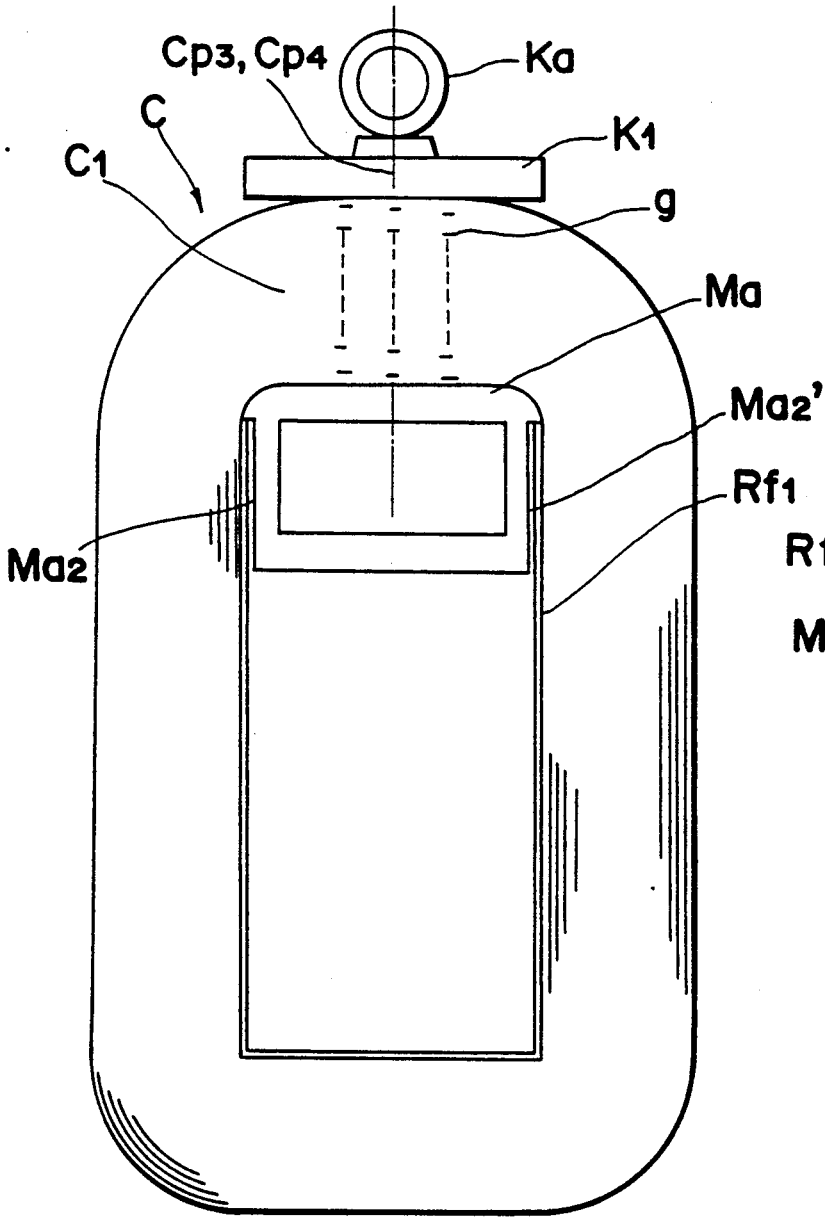
Figure 15B:
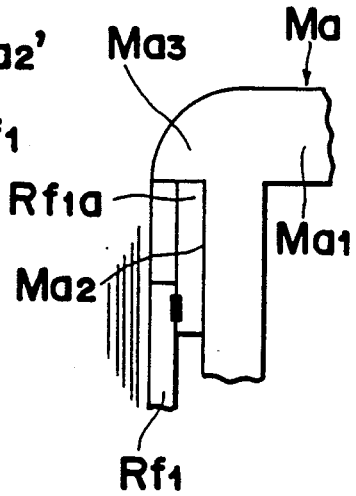

FIG. **14*a*** is a perspective view of a reinforcement frame;

FIG. **14*b*** is an enlarged perspective view of a stopper of another preferred embodiment;

FIG. 14*c* is an enlarged perspective view of a stopper of a preferred embodiment;

FIG. 15*a* is front view of the core on which a first reinforcement frame is mounted;

FIG. 15*b* is an enlarged front view of the end portion of the first reinforcement frame shown in FIG. 15*a;*

Figure 18:
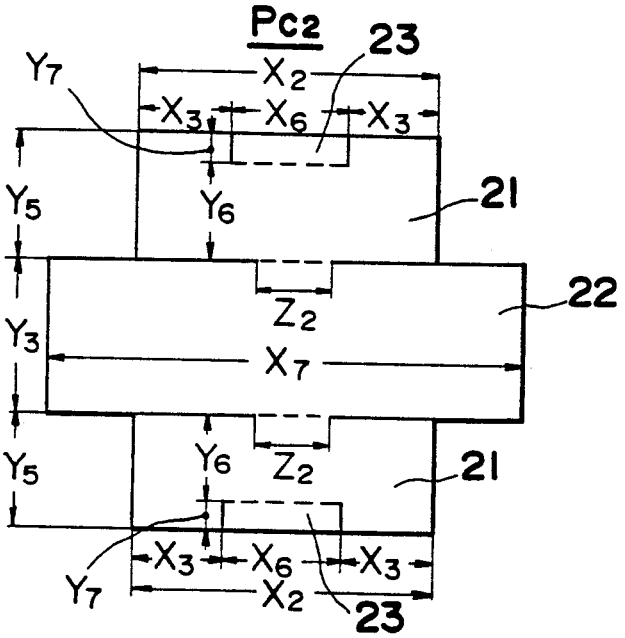
Figure 19:
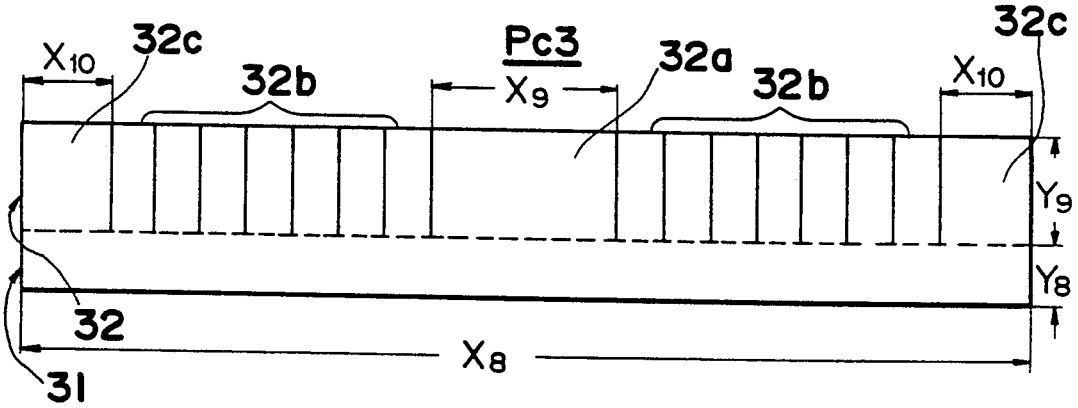
Figure 20:
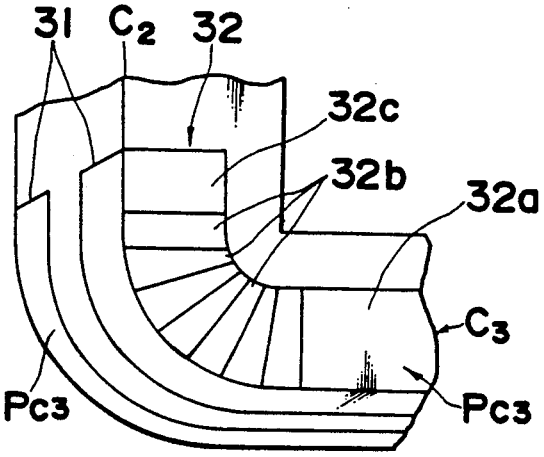
Figure 21:
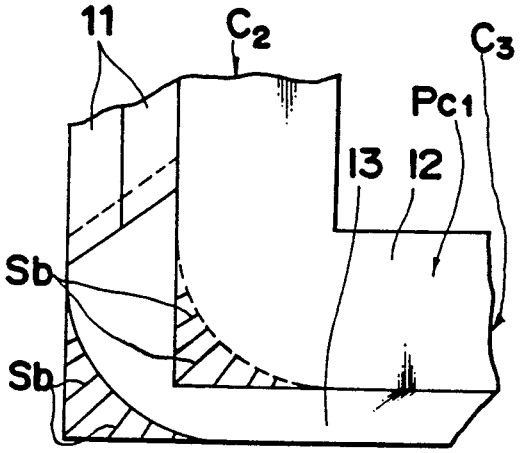
Figure 22:
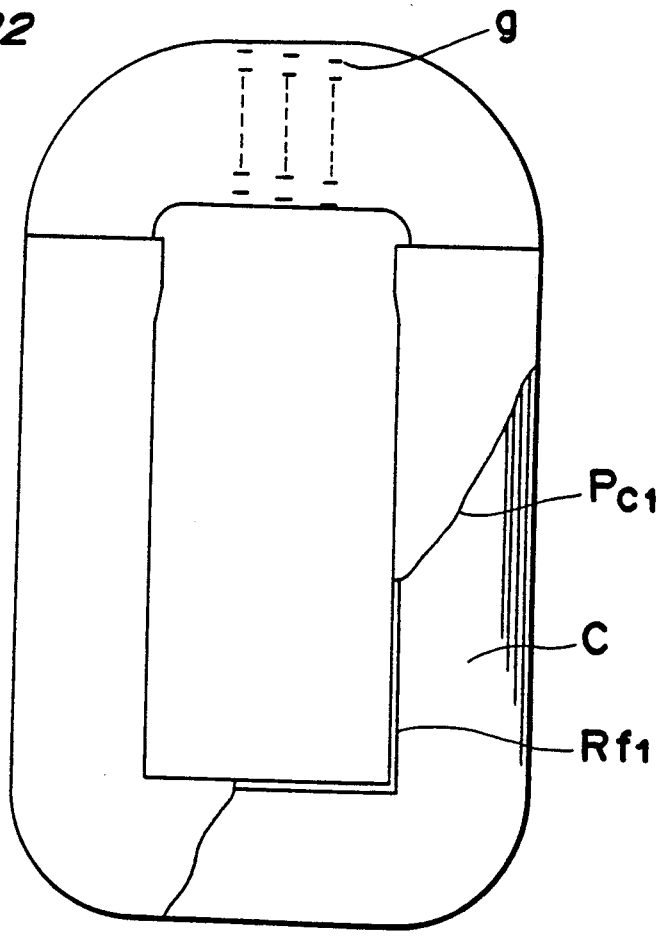
Figure 23:
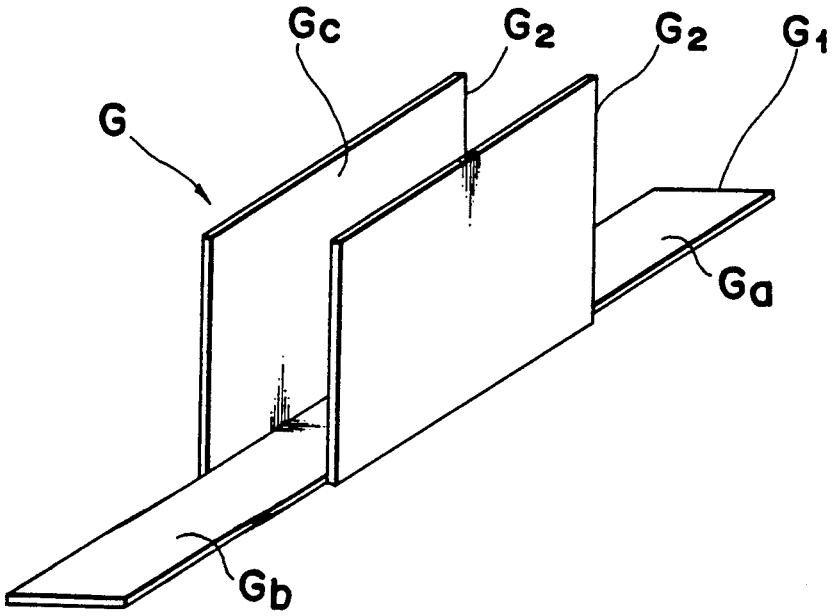
Figure 25:
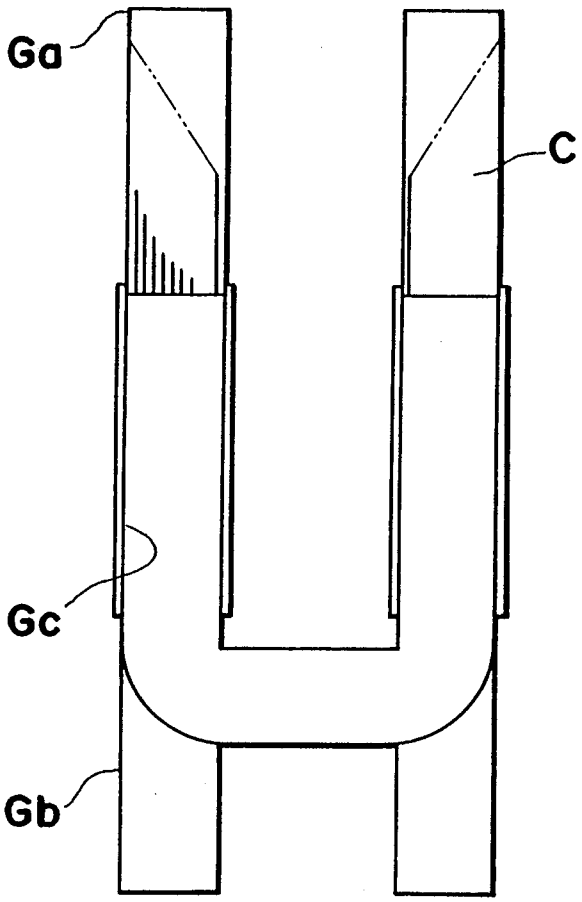
Figure 24:
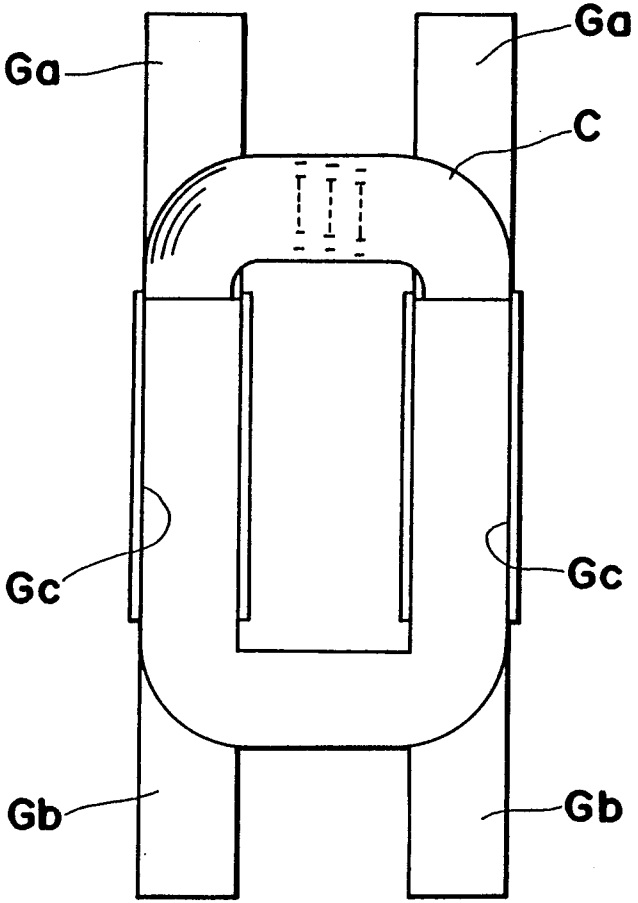
Figure 27:
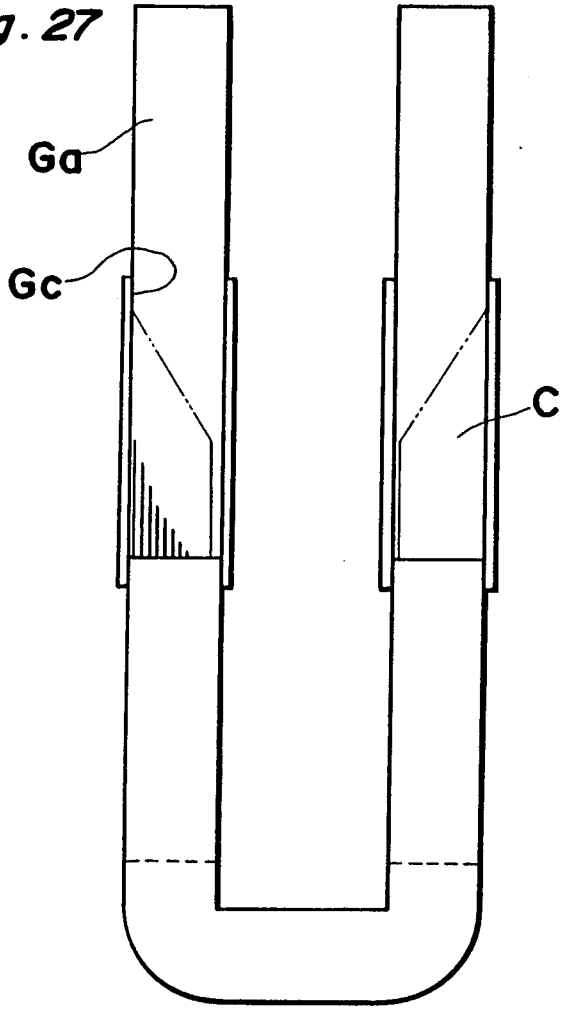
Figure 26:
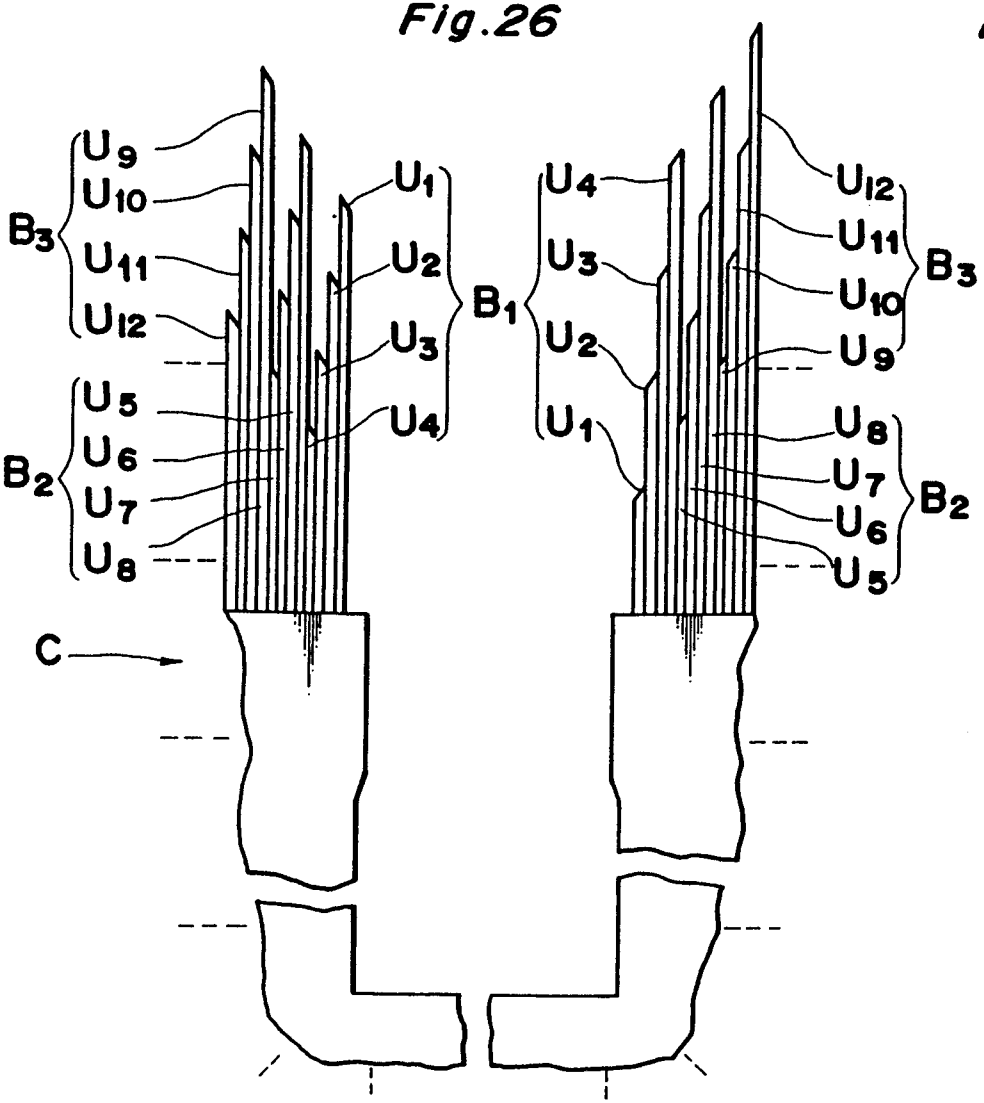
Figure 29:
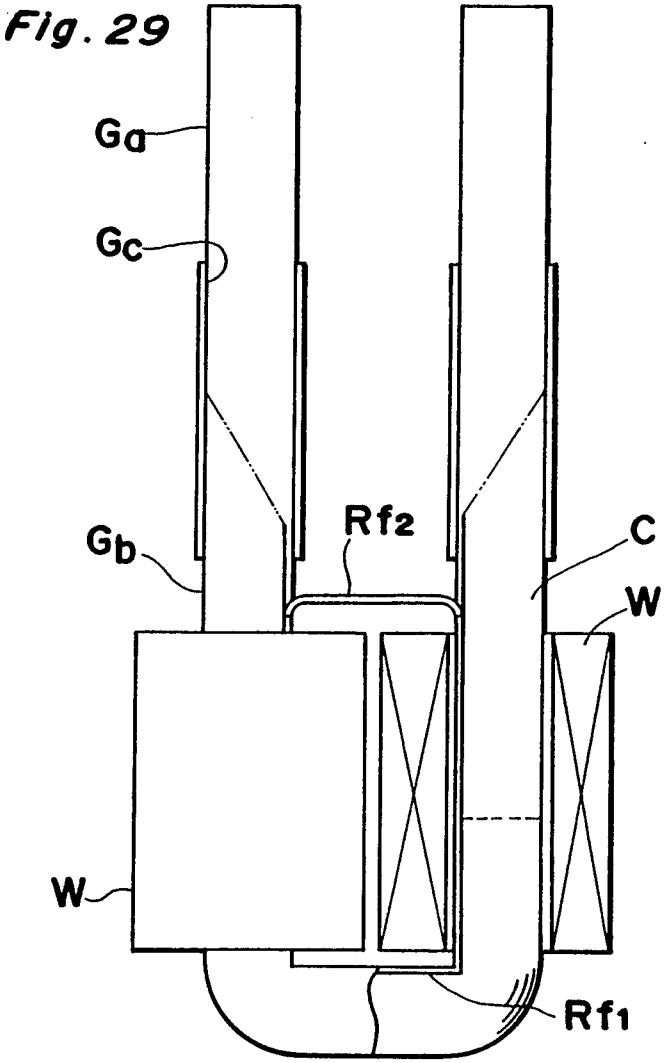
Figure 28:
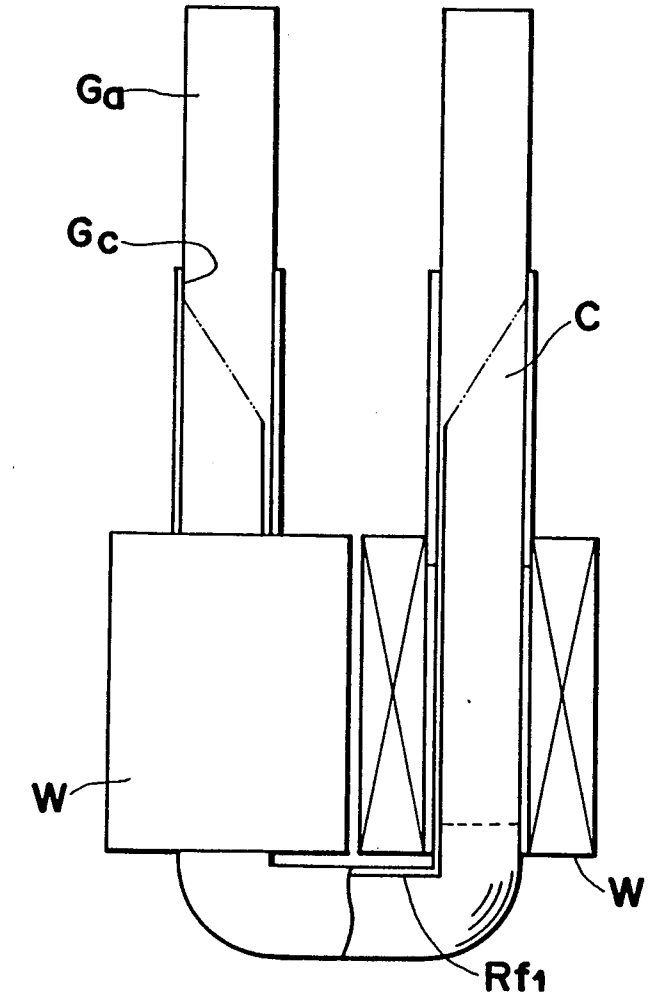
Figure 31:
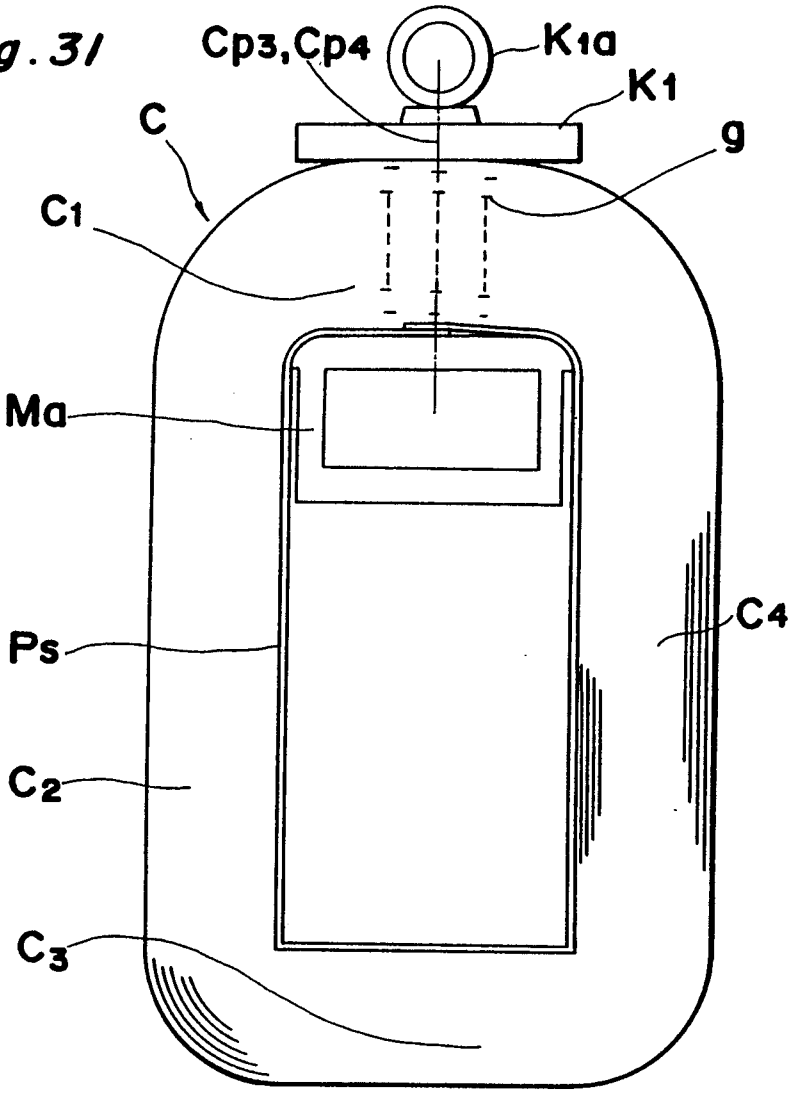
Figure 30:
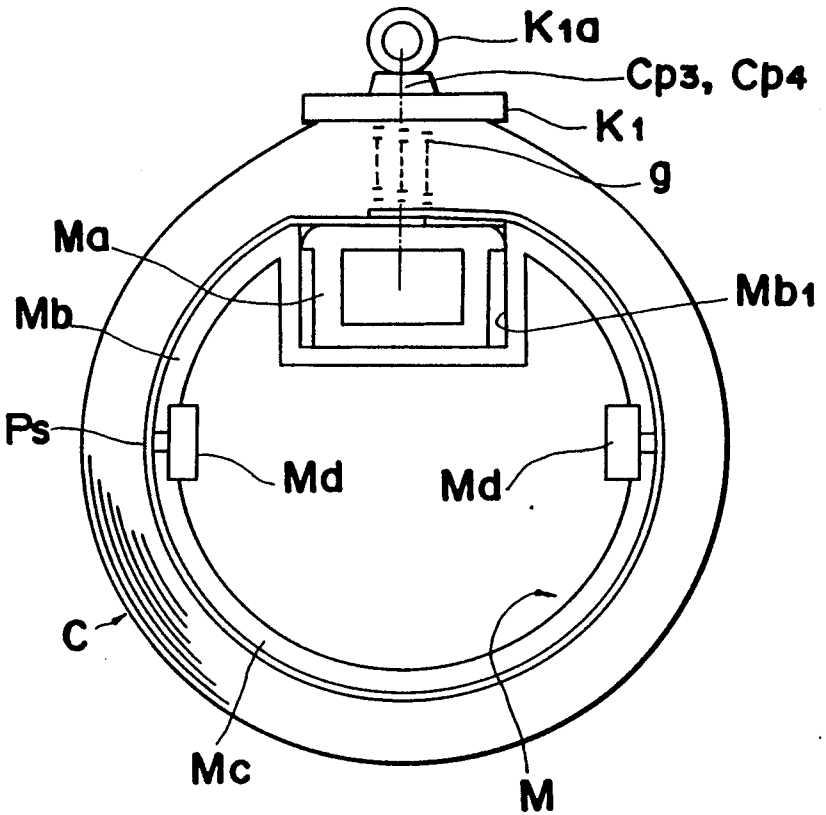

FIG. 16 is a perspective view of a large cover and a small cover to be mounted on the core;

FIG. 17 is a developed view of the large cover shown in FIG. 16;

FIG. 18 is a developed view of the small cover shown in FIG. 16;

FIG. 19 is a developed view of an end portion cover;

FIG. 20 is a partial perspective view showing a state that the end portion cover is mounted on the core;

FIG. 21 is a partial perspective view of an end portion of the large cover showing a processing method of a portion projected from a surface of the core;

FIG. 22 is a partial broken front view of the core after mounting a first protective cover portion;

FIG. 23 is a perspective view of a guiding jig;

FIG. 24 is a front view showing a state that the guiding jig is mounted on the core shown in FIG. 22;

FIG. 25 is a front view showing a state that joint portion of the core shown in FIG. 24 is opened;

FIG. 26 is an enlarged partial view of the opened joint portion shown in FIG. 25;

FIG. 27 is a front view showing a state that a channel portion of the guiding jig is positioned on the opened joint portion of the core;

FIG. 28 is a partial broken front view showing a state that windings are fitted around the core shown in FIG. 27;

FIG. 29 is a partial broken front view showing a state that a second reinforcement frame is mounted on the core;

FIG. 30 is a front view showing a state that all the lamination blocks are wound around the bobbin so as to form a core after mounting a protective sheet inside of the most-inside lamination block; and FIG. 31 is a front view showing a state that the other parts than the shaping part of the rectangular shaping tool are removed after shaping the core shown in FIG. 30 into a rectangular configuration.

DETAILED DESCRIPTION OF THE PREFERRED EMBODIMENT

A preferred embodiment according to the present invention will be described below with reference to the attached drawings.

Figure 1:
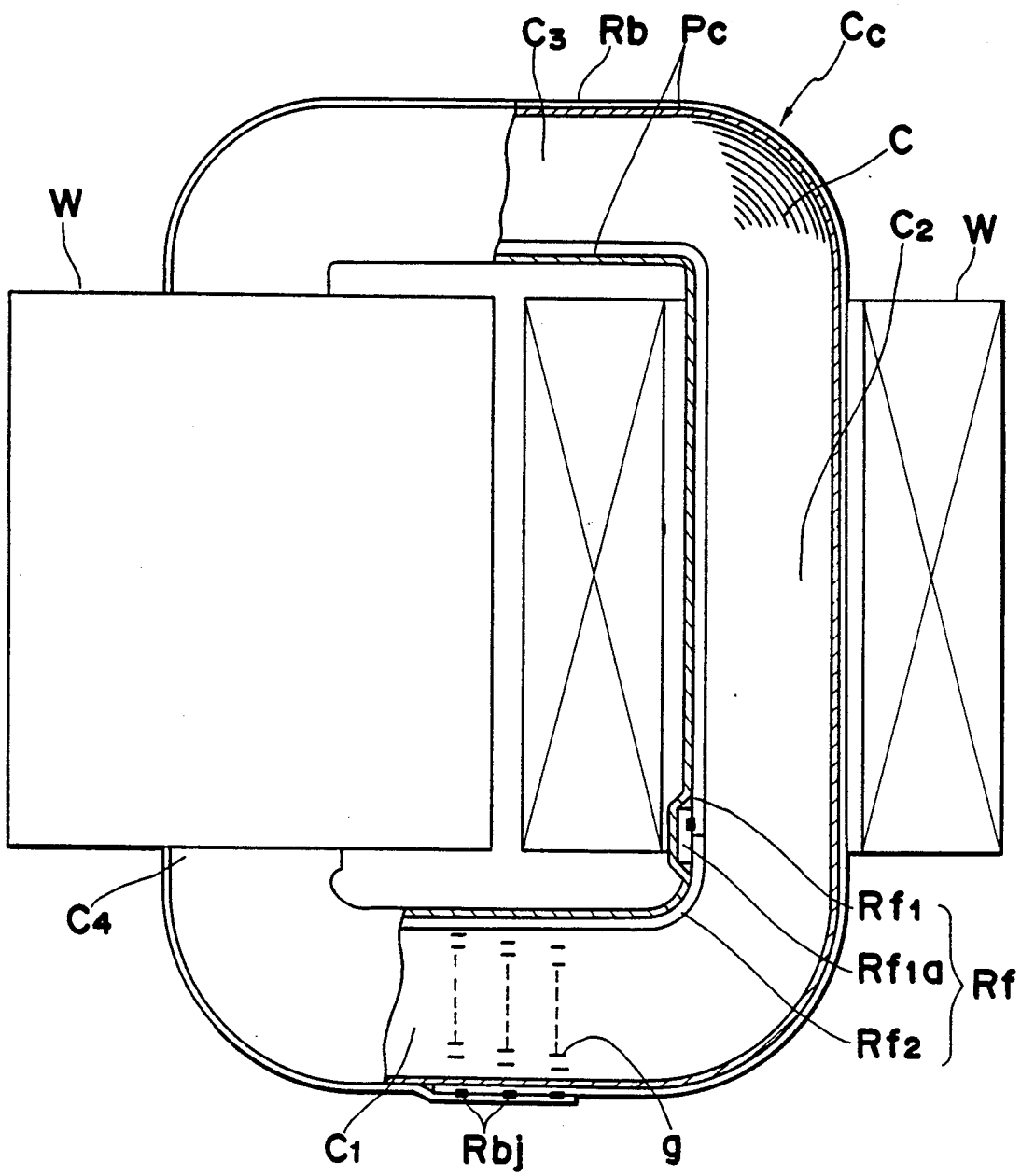
FIG. 1 is a partial broken front view of a transformer of a preferred embodiment according to the present invention.

FIG. 1 shows the whole composition of a core type transformer of the preferred embodiment according to a stationary induction electric apparatus of the present invention. A rectangular core C is formed by stacking strips F of an amorphous magnetic alloy, and a reinforcement frame Rf made of an iron plate is mounted on the inner surface thereof. The inner and outer surfaces of the core C and the reinforcement frame Rf are covered by a protective cover Pc made of an insulating sheet. Furthermore, a reinforcement band Rb is wound on the outer surface of the protective cover Pc so as to cover the outer surface of the core C.

It is to be noted that the strips F are built up into a lamination block as described later having a thickness Tc in order to make it function as a magnetic circuit of a transformer, so as to form the above core C. The core C on which the reinforcement frame Rf, the protective cover Pc and the reinforcement band Rb are mounted is called a complete core Cc hereinafter.

Windings W are fitted around both the leg portions C2 and C4 of the complete core Cc so as to constitute the main body of the transformer.

The present invention relates to a method for manufacturing a stationary induction electric apparatus including a process for obtaining the complete core Cc from the core C, and also to a stationary induction electric apparatus constituted by fitting windings around the complete core Cc.

In the following description, first of all, a process for manufacturing the core C from the strip F will be described schematically, and thereafter, the subject matter of the present invention will be described in detail.

Upon manufacturing the core C, first of all, a strip F of an amorphous magnetic alloy is wound on a circular bobbin (not shown) so as to form a ring-shaped lamination R. As described above, the strip F has an extremely small thickness of about 25 $\mu$ms.

Figure 2:
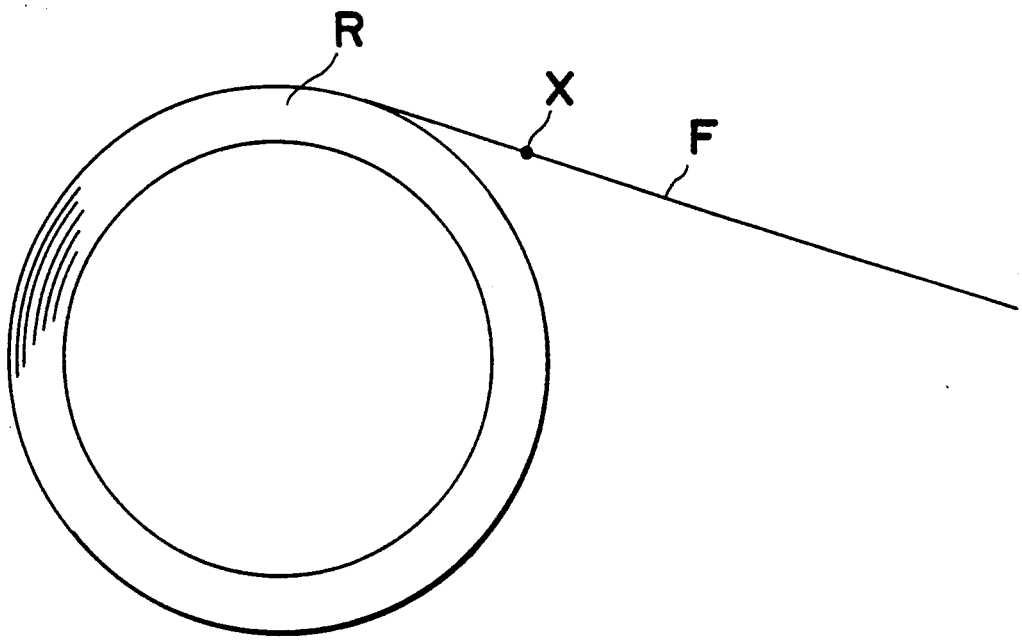
FIG. 2 is a front view of a strip showing a state that a strip has been wound completely.

FIG. 2 shows the ring-shaped lamination R when winding of the strip F is completed. After winding of the strip F is completed, the strip F is cut off at a point X shown in FIG. 2 so as to form the ring-shaped lamination R. Thereafter, after the ring-shaped lamination R is cut off at one point thereof in a stacking direction orthogonal to the surface of the strip F and is extended so as to form a developed lamination S, plural lamination units U are formed. Plural lamination units U are stacked so as to constitute a lamination block B. Furthermore, plural lamination blocks B are wound on the bobbin, and both ends of respective lamination units U are jointed with overlapping them so as to manufacture a ring-shaped core C.

The above process will be described below.

Figure 3:
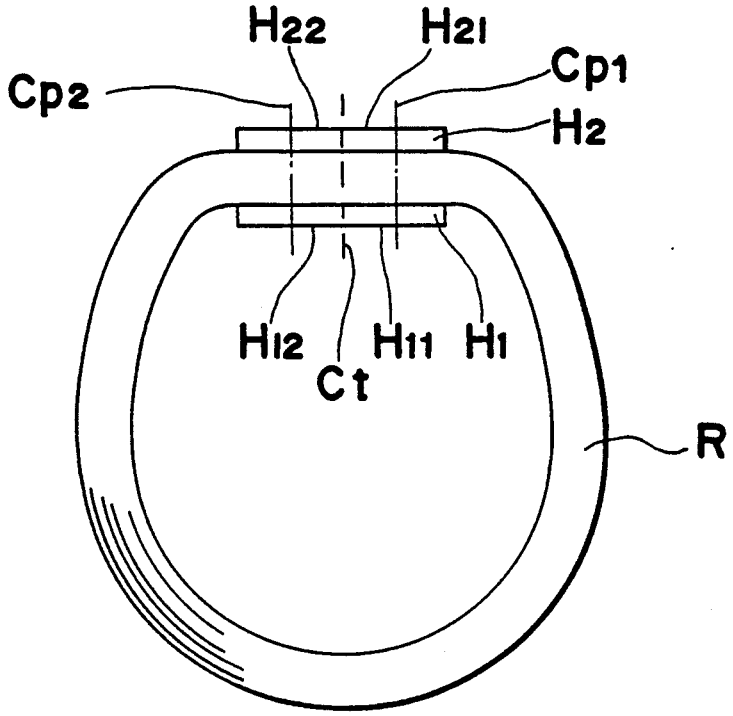
FIG. 3 is a front view showing a state of a ring-shaped lamination clamped by a pair of holding plates.

After the ring-shaped lamination R is formed as shown in FIG. 2, the ring-shaped lamination R is clamped by a squill vise (not shown) after placing a pair of holding plates H1 and H2 so as to put a portion of the ring-shaped lamination R between them in a radial direction thereof. In FIG. 3, positions indicated by chain lines Cp1 and Cp2 represent clamp positions by the squill vise, which are respectively selected at the center positions when seen in the direction of width of the ring-shaped lamination R.

After clamping the ring-shaped lamination R, it is cut off at a center position of the holding plates H1 and H2 indicated by a chain line Ct in the radial direction together with the holding plates H1 and H2. As the result, the holding plates H1 and H2 are also cut into halves H11, H12, H21 and H22, respectively.

After cutting the ring-shaped lamination R, one end thereof is kept in the clamped state while the other end is released by unclamping one-half of the squill vise and the halves H12 and H22 of respective holding plates H1 and H2 are removed.

Figure 4:
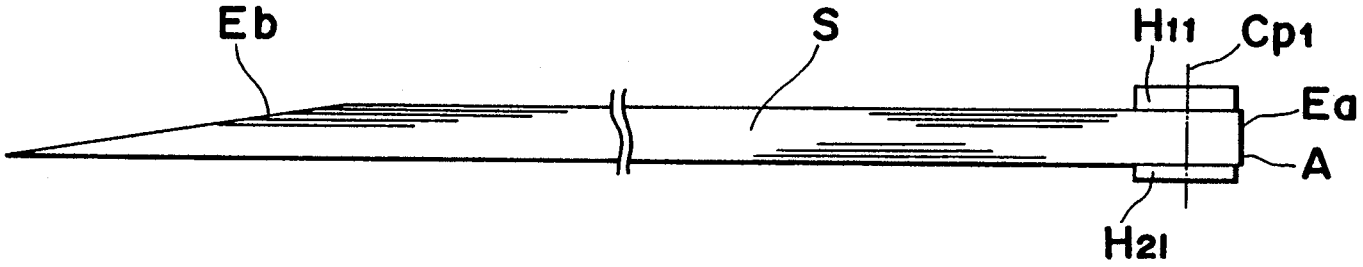
FIG. 4 is a front view of a lamination developed by cutting the ring-shaped lamination.

Thereafter, the ring-shaped lamination R is extended in a straight line to form a developed lamination S while clamping one end thereof, as shown in FIG. 4. The process from the state of FIG. 3 to that of FIG. 4 is defined as the step for forming the developed laminations.

As shown in FIG. 4, the cut face Ea of the clamped end of the developed lamination S is held perpendicularly to the length-wise direction thereof while the other cut end Eb thereof forms a plane inclined to the length-wise direction thereof.

After forming the developed lamination S, an adhesive agent is applied to each of cut faces Ea of them. The adhesive agent of solvent volatile type is desirably usable. In the present preferred embodiment, Plio bond ® offered by Ashland Chemical Company is used after diluting it with a suitable solvent.

Figure 5:
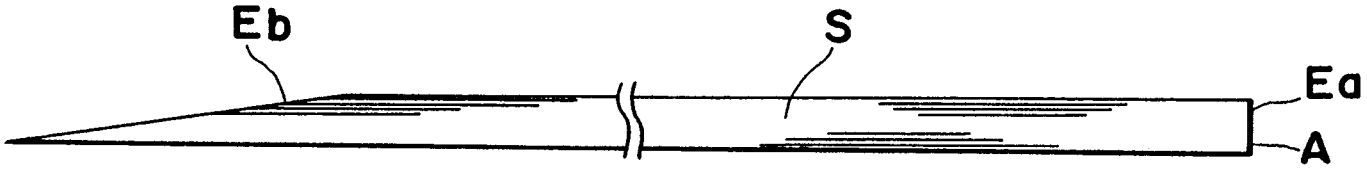
FIG. 5 is a front view of the developed lamination from which the pair of the holding plates have been removed.

The applied adhesive agent is dried in air for several minutes to form a membrane as indicated by A in FIG. 5. The membrane is omitted in the other FIGS. than FIGS. 4 and 5.

When the membrane A applied on the cut surface Ea is dried properly, the halves H11 and H21 of the holding plates H1 and H2 are removed as shown in FIG. 5.

In this state, respective strips F forming the developed lamination S are held by the adhesive force of the membrane A so as not to shift each other after removing the clamp force since the membrane A of the adhesive agent is formed on the cut surface Ea.

Thereafter, the developed lamination S is divided into plural lamination units by packaging every predetermined number of strips F so as to have a proper thickness. In this case, the thickness Tu of each lamination unit U is desirably set at a value ranging from 0.3 mms to 1 mm. These lamination units are indicated by suffixed capital letters U1, U2, ... which are assigned in an order of increase with respect to the length of the unit.

Next, respective lamination blocks B1, B2, ... are formed using four lamination units in the preferred embodiment. In this example shown in FIG. 6, one lamination block B1 is constituted from four lamination units U1 to U4. In this case, respective lamination blocks B1, B2, ... are constituted using every four lamination units U1 to U4, U5 to U8, and so on.

Each lamination block is built up by piling respective lamination units one by one from the shortest one on a level block (not shown) in a manner shifted by a predetermined standard shift length ΔLs in the length-wise direction of the lamination block at the side of the cut face Ea. In the present preferred embodiment, the standard shift length ΔLs is desirably set at a value in the range from 5 mms to 20 mms.

Figure 6:
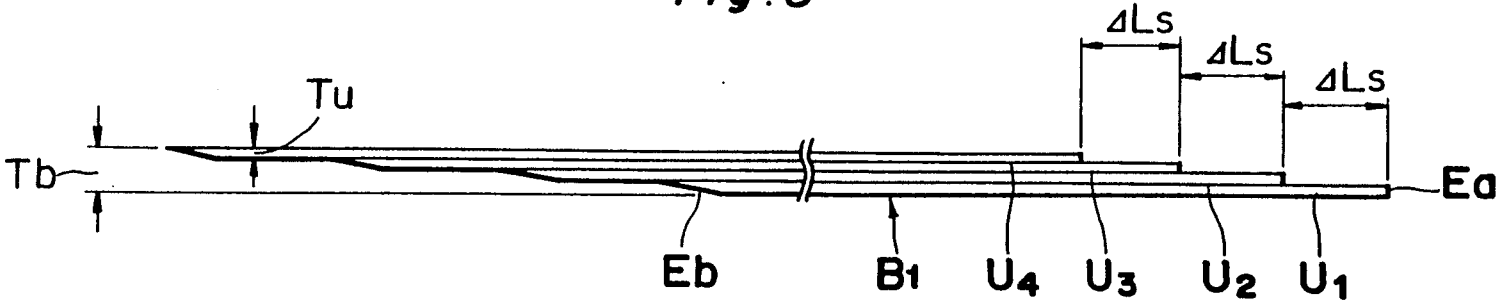
FIG. 6 is a front view of a lamination block formed by piling up unit laminations.

The process for forming the lamination block will be explained more concretely referring to FIG. 6 which shows a structure of the first lamination block B1.

At first, the lamination unit U1 is put on the level plate (not shown) that the shorter side of the stripe F faces the level plate. Then, the second unit U2 is piled on the first unit U1 facing the shorter side thereof downwardly. Upon piling it, the position of the cut surface Ea of the second unit U2 is shifted from the adhered end Ea of the first unit U1 by the standard shift length ΔLs in the length-wise direction thereof.

Similarly, the third and fourth units U3 and U4 are piled respectively to form the lamination block B1 finally.

The lamination blocks from B2, B3, ... are built up in the same manner as the first one.

After the process for forming the lamination blocks, a process for joining these lamination blocks is performed using a bobbin prepared for winding respective lamination blocks. These blocks are wound one by one from the shorter side with respect to the length of the block. Each block is wound from the leading end thereof which is defined as the end shifted by the standard shift length ΔLs between adjacent units. The other ends of respective lamination units are joined and overlapped with respective leading ends of them in such a manner that the leading end of each unit is overlapped with the trailing end of the same.

Figure 7:
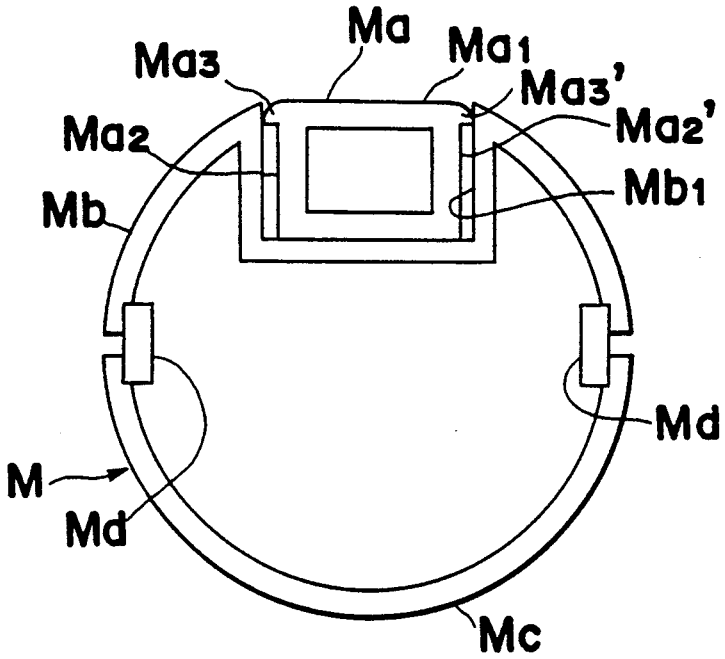
FIG. 7 is a plan view showing a bobbin for winding the lamination block therearound and a winding apparatus therefor.

FIG. 7 shows a bobbin M to be used for winding the lamination blocks.

The bobbin M is substantially comprised of a first semicircular member Mb, a second semicircular member Mc and a shaping tool Ma of a square configuration for defining a joint portion of the lamination block which is fitted in a square dent Mb1 formed in the first semicircular member Mb. The first and second semicircular members Mb and Mc are connected each other by joints Md and Md so as to build up the bobbin M. In the present preferred embodiment, the main portion of the bobbin is constituted by the members Mb and Mc, and the joints Md and Md. Each joint Md is tied to respective ends of the first and second semicircular members Mb and Mc by bolts (not shown). The shaping tool Ma is not fixed in the dent Mb1 so as to be able to separate it from the first semicircular member Mb.

The bobbin M is arranged on a horizontal level block (not shown) so as for the axis thereof to be perpendicular to the level block and is fixed unrotatably by plural pins projected therefrom each of which is fitted into corresponding hole provided on the bobbin M.

This bobbin M has a configuration symmetric with respect to the center line of the shaping tool Ma having a flat outer surface Ma1. This surface Ma1 is positioned corresponding to a position of a side of a core window at a yoke side thereof and has a length equal to the side of the core window. Furthermore, the total outer peripheral length of the bobbin M is set equal to the inner peripheral length Lci of the wound core.

Both end side surfaces of the shaping tool Ma which are orthogonal to the flat surface Ma1 are formed so that the portions other than the end portions Ma3 and Ma3' near to the flat surface Ma1 of both end side surfaces thereof are positioned inside by a predetermined length from the end portions Ma3 and Ma3' near to the flat surface Ma1, and the inside portions thereof become step portions Ma2 and Ma2' for mounting a plate member. These step portions is utilized upon mounting the reinforcement member and the protective cover in the process described later.

A well-known winding apparatus (not shown) for winding the lamination blocks B1, B2, ... around the bobbin M is provided, however, the description thereof is omitted therein.

In a process for overlapping and jointing respective lamination blocks, the lamination blocks B1, B2, ... are wound in the order from the shorter one to the longer one around the bobbin M using one end portion on the side of the cut surface Ea on which the adhesive agent is applied as a winding start point, and both ends of respective lamination units of respective lamination block are overlapped and jointed at the portion of the flat surface Ma1 of the bobbin M.

Figure 8:
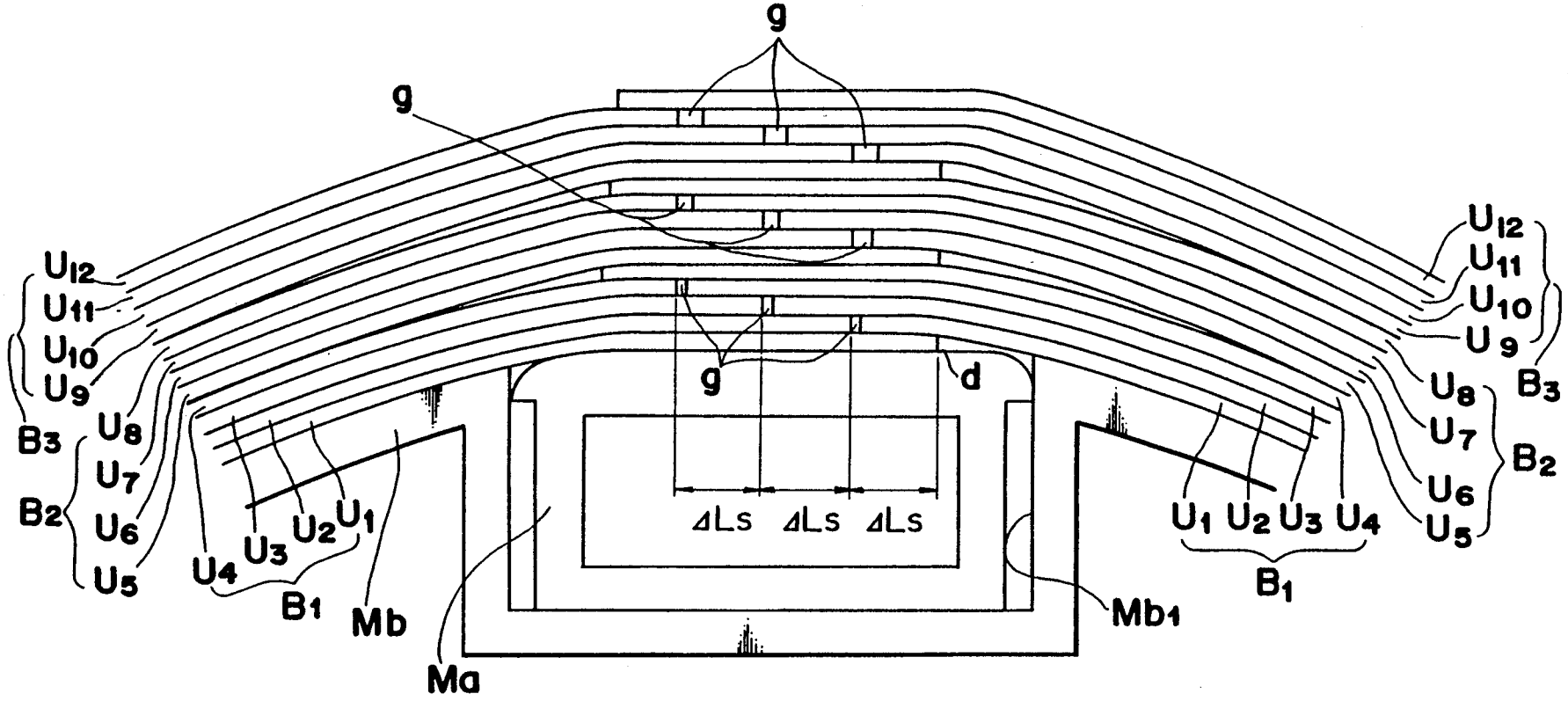
FIG. 8 is an enlarged partial view of a joint section of the lamination block wound around the bobbin shown in FIG. 7.

FIG. 8 is an enlarged side view of the joint portion of the lamination blocks and shows a state that the first to third lamination blocks B1 to B3 have been wound.

At first, the first lamination block B1 comprised of the lamination units U1 to U4 is wound around the bobbin M. Upon winding it, the leading end of the first lamination unit U1 being the most-inner unit is set at a predetermined position "d" on the flat portion Ma1 of the shaping tool Ma which is set near one end thereof. Then, the first block B1 is wound around the bobbin M in the order of the other end of the shaping tool Ma, the left side portion of the first semicircular member Mb, the left side portion of the second semicircular member Mc, the right side portion of the second semicircular member Mc, the right side portion of the first semicircular member Mb and the one end of the shaping tool Ma. Thus, the trailing ends of the first to fourth lamination units U1 to U4 are piled on the leading ends of them in an overlapped fashion. Namely, each trailing end thereof is overlapped with each leading end of the same lamination unit to form a stepping joint. In this winding process, each of the strips forming the lamination unit can slide relatively with each other since it is free from binding force at the trailing end side thereof.

As is apparent from FIG. 8, the thickness of lamination in the joint portion of the wound lamination block B1 becomes larger than the thickness Tb of the other portion thereof by the thickness Tu of one lamination unit. Accordingly, the total peripheral length of the lamination block B1 wound in a overlapped fashion becomes slightly larger than that of the wound lamination block assumed to have a uniform thickness equal to the thickness Tb around the lamination block.

Due to this, respective gaps g are formed between the leading end of a lamination unit and the leading end of the adjacent lamination unit in the joint portion of the wound core, as shown in FIG. 8.

Figure 9:
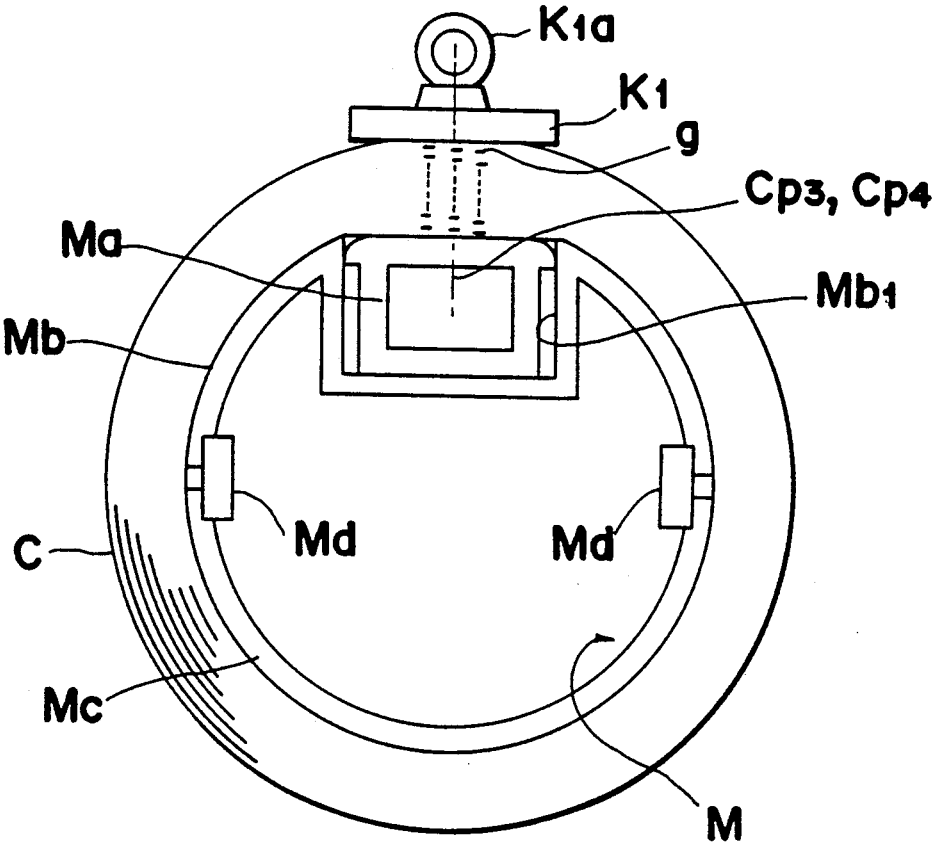
FIG. 9 is a front view of a core formed by winding all lamination blocks around the bobbin.

When all the lamination blocks have been wound, a plate-shaped pressing tool K1 is set on a portion of the outer periphery of the wound core corresponding to the shaping tool Ma so as to clamp the joint portion of the core therebetween using a clamping means such as a squill or a bolt means, as shown schematically in FIG. 9. A chain line Cp3 (Cp4) shown in FIG. 9 indicates the center line of the clamp. The pressing tool K1 provides a hook K1*a* for hanging the core to move the same.

After clamping the joint portion of the core between the shaping tool Ma and the pressing tool K1, the bobbin M is disassembled into parts Mb, Mc and Md except for the shaping tool Ma. Therefore, connecting tools Md are removed therefrom by loosing bolts at first. When they are removed, respective gaps between the two semicircular members Mb and Mc are closed to allow the parts to draw out of the circular core C.

Figure 10:
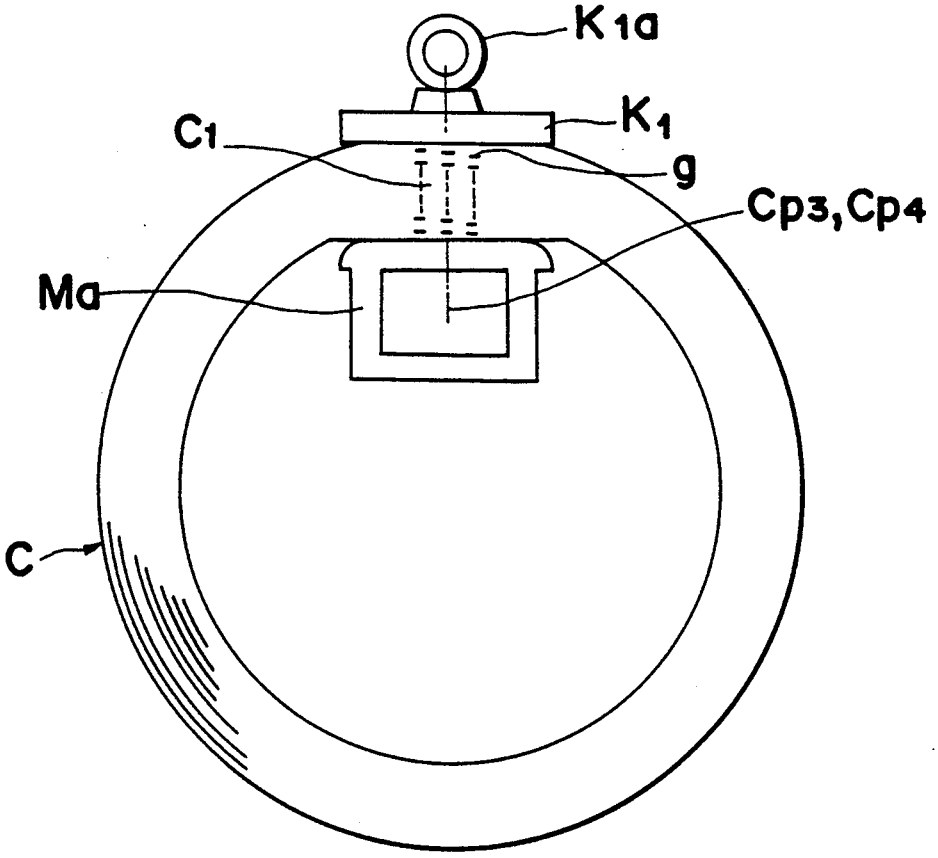
FIG. 10 is a front view showing the core after removing parts of the bobbin except for a shaping tool for the joint section thereof.

FIG. 10 shows this state.

Thereafter, the process for shaping the core into a rectangular configuration is performed. The rectangular of the core C has four sides C1, C2, C3 and C4 when seen in the counterclockwise direction (the winding direction of the lamination block). The top and bottom sides Cl and C3 are called yoke portions, and the left and right sides C2 and C4 are called leg portions around which windings are fitted. The top side C1 includes the joint section of the core.

In the state shown in FIG. 10, the top side C1 has been formed, and accordingly, it is necessary to shape the other three sides C2, C3 and C4 for forming a rectangular core.

Figure 11:
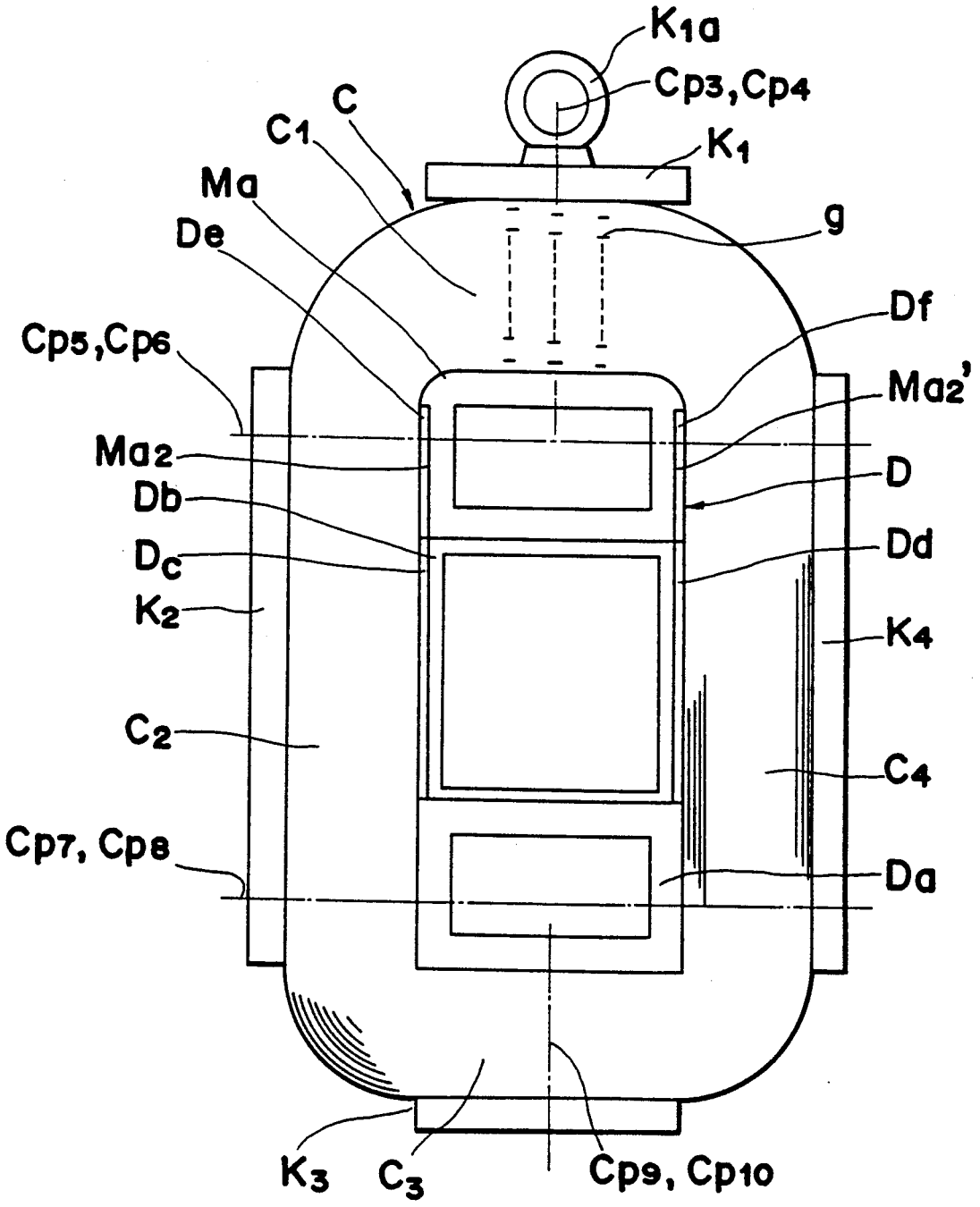
FIG. 11 is a front view of the core shaped into a rectangular configuration.

Therefore, there is provided a shaping tool D having a configuration such that it forms a configuration of the window portion of the rectangular core together with the shaping tool Ma, as shown in FIG. 11. In this example, the shaping tool D is comprised of five parts Da to Df. The part Da of a rectangular configuration is arranged to form the bottom side C3 oppositely to the shaping tool Ma and between the part Da and the shaping tool Ma, a square cylindrical part Db is arranged. Two plate-shaped parts Dc and Dd are inserted into respective gaps defined between the square cylindrical part Db and the core, respectively. Further, two plate-shaped parts De and Df are inserted into gaps defined between respective side wall of the shaping tool Ma and the core.

In FIG. 11, the edges of the outer surface of the part Da is drawn in an orthogonal configuration, however, the bottom edges thereof on the side of the core C3 are formed in a rounded configuration. The radius of the rounded portions of the part Da is considerably smaller than that of the edges of the shaping tool Ma on the side of the core C1.

Since the shaping tool D is comprised of plural parts which can be easily disassembled, the insertion and disassembly of them can be made easily.

The parts of the rectangular shaping tool D are mounted as follows.

First of all, the parts De and Df are mounted on the step portions Ma2 and Ma2'. Through holes (not shown) are formed in the parts De and Df at positions facing both outside portions of the core C in the direction of the width of the strip F, and screw holes (not shown) respectively corresponding to the above through holes are formed in the step portions Ma2 and Ma2'. Bolts are inserted into the through holes and are screwed into the screw holes of the step portions Ma2 and Ma2', respectively, so as to fix the parts De and Df on the shaping tool Ma. It is to be noted that the parts De and Df may be mounted and fixed in the foregoing process.

Next, the core C shown in FIG. 10 is suspended using the hook portion K1*a* of the part K1, and the part Da is arranged on the bottom portion of the inner surface of the core C so as to face the shaping tool Ma.

Thereafter, an extension tool such as a jack is inserted between the shaping tool Ma and the part Da, and the distance between the shaping tool Ma and the part Da is increased by the extension tool so as to set the dimensions of the window portion of the core C in the widthwise and height-wise directions at predetermined values (designed values), respectively.

In this state, the parts Dc and Dd are inserted thereto, and the extension tool is shortened and taken out. Thereafter, the part Db is inserted thereto. Then, the rectangular shaping part D is mounted in the window portion of the core C.

After shaping the inner periphery of the core by inserting the rectangular shaping tool D, plate-shaped press tools K2 to K4 are put on respective outer surfaces of the three sides C2 to C4, as indicated by chain lines Cp5, (Cp6), Cp7, (Cp8) and Cp9 (Cp10) in FIG. 11, and the core is clamped using suitable clamping means between the press tools K2 and K4 and between the rectangular part Da and the press tool K3 in order to shape the outer periphery of the core. In FIG. 11, chain lines Cp3, Cp5, Cp7 and Cp9 having respective odd numbered suffixes indicate respective clamp positions on the front side of the core and alphanumerical reference signs Cp4, Cp6, Cp8 and Cp10 having respective even numbered suffixes indicate clamp positions on the rear side of the core.

In the present shaping method, the joint section of the core is kept in the clamped state and, therefore, individual joints are held as they are, during the shaping operation. This enables to manufacture cores of high quality without any defects of joints.

After shaping the core into a rectangular configuration, magnetic annealing of the core is performed to remove distortions having been caused in the core during the manufacturing process thereof and, thereby, the magnetic property thereof once lowered due to distortions is recovered desirably. In place of the magnetic annealing, a suitable thermal annealing can be done without applying any magnetic field.

Figure 12:
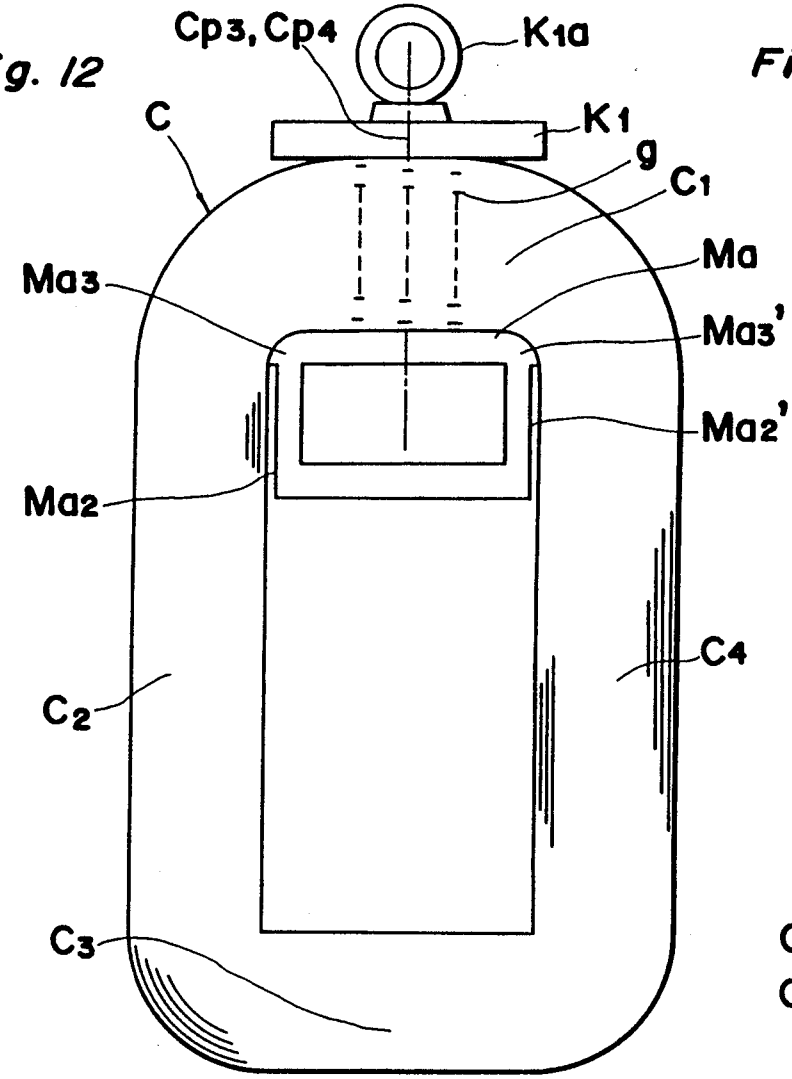
FIG. 12 is a front view showing a state of the core formed by removing the other parts than the shaping part of the rectangular shaping tool after shaping the core into a rectangular configuration.

After annealing the core, all parts of the shaping tools Ma and D are removed to obtain a bare core of a rectangular shape as shown in FIG. 12.

Figure 13:
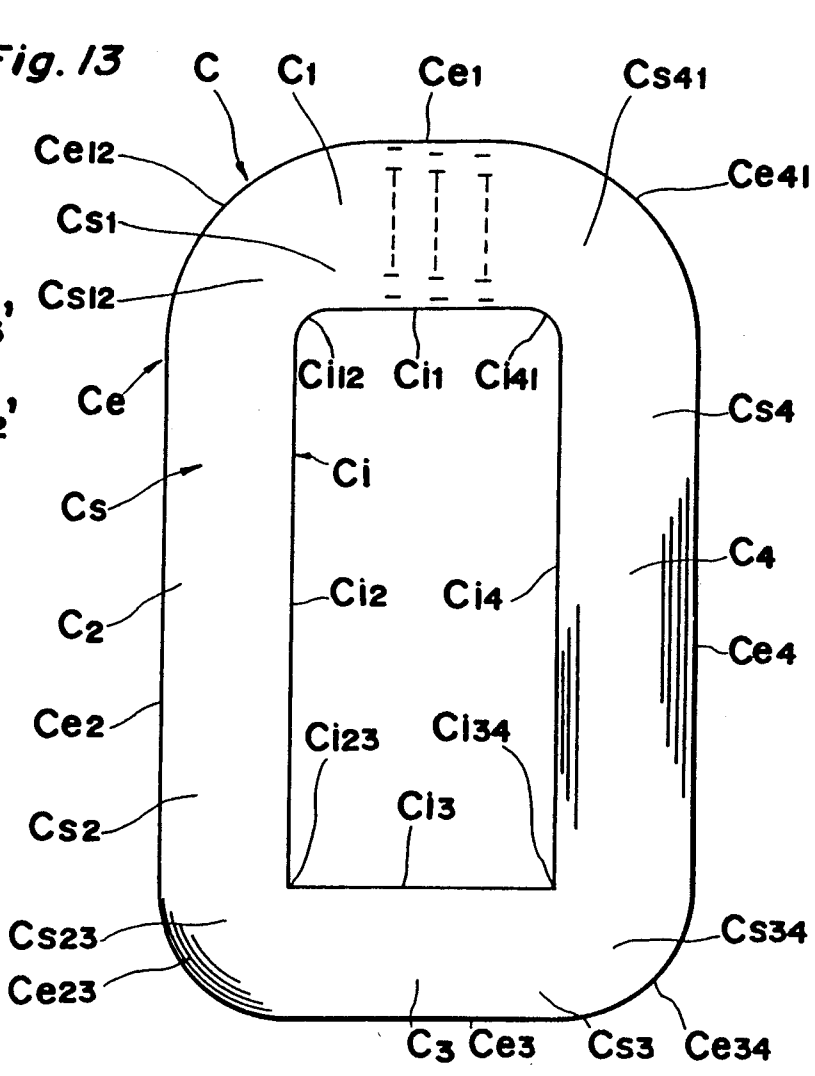
FIG. 13 is a front view of the core for explaining symbols for denoting respective portions of the core.

For convenience of explanation, respective portions of the core C are represented by symbols, respectively, as shown in FIG. 13. A state that the clamping tool is disassembled from the core C is shown in FIG. 13 used only for explaining the symbols of respective portions of the core C.

In FIG. 13, Ci, Ce and Cs denote the inner peripheral surface, the outer peripheral surface and the side surfaces of the core C, respectively. There are one inner peripheral surface Ci, one outer peripheral surface Ce, and two side surfaces.

The respective portions positioned along the yoke portion C1, the leg portion C2, the yoke portion C3 and the leg portion C4 on respective portions of the inner peripheral surface Ci of the core C are represented by symbols Ci1, Ci2, Ci3 and Ci4, respectively. The corner portion between the portions C1 and C2 of the inner peripheral surface Ci, the corner portion between the portions C2 and C3 thereof, the corner portion between the portions C3 and C4 thereof and the corner portion between the portions C4 and C1 thereof are represented by Ci12, Ci23, Ci34 and Ci41, respectively.

In FIG. 13, the portions Ci23 and Ci34 are drawn in an orthogonal configuration, however, the above portions of the actual core C are formed in a small rounded configuration. The radius of the rounded portion of the portions Ci23 and Ci34 are smaller than that of the portions Ci12 and Ci41.

The respective portions positioned along the yoke portion C1, the leg portion C2, the yoke portion C3 and the leg portion C4 of the outer peripheral surface Ce are represented by symbols Ce1, Ce2, Ce3 and Ce4. The corner portion between the portions C1 and C2 of the outer surface of the core C, the corner portion between the portion C2 and C3 thereof, the corner portion between the portions C3 and C4 thereof, and the corner portion between the portions C4 and C1 are represented by symbols Ce12, Ce23, Ce34 and Ce41, respectively.

Respective portions positioned along the yoke portion C1, the leg portion C2, the yoke portion C3 and the leg portion C4 of the side surface Cs of the core C are represented by symbols Cs1, Cs2, Cs3 and Cs4, respectively. The corner portion between the portions C1 and C2 of the side surface Cs of the core C, the corner portion between the portions C2 and C3 thereof, the corner portion between the portions C3 and C4 thereof, and the corner portion between the portions C4 and C1 thereof are represented by symbols Cs12, Cs23, Cs34 and Cs41, respectively.

The reinforcement frame Rf is mounted on the inner peripheral surface Ci of the core C as shown in FIG. 14*a*. The reinforcement frame Rf supports the core C from the inside thereof so as to hold the shape of the window portion thereof, and covers the inner peripheral surface Ci of the core C so as to protect there. Furthermore, the reinforcement frame Rf prevents the broken pieces of the strip F from leaving there to the outside thereof.

The reinforcement frame Rf is comprised of a first U-shaped reinforcement frame Rf1 having a larger height, and a second U-shaped reinforcement frame Rf2 having a smaller height, which are faced and jointed with each other.

The reinforcement frame Rf is made of an iron plate having a thickness of about 1 mm, a width "e" equal to that of the strip F, and a length of the outer periphery equal to the length Lci of the inner periphery of the core C.

The first and second reinforcement frames Rf1 and Rf2 are arranged so that the joint portions thereof are positioned within the window portion of the core C at boundary portions between the straight portion of the leg portions C2 and C4 on the side of the yoke portion C1 and the rounded portions thereof, wherein the first reinforcement frame Rf1 is positioned on the side of the yoke portion C3 from above boundary portion, and the second reinforcement frame Rf2 is positioned on the side of the yoke portion C1 therefrom.

In FIG. 14*a*, stoppers Rf1*a* are mounted on the inside of the first reinforcement frame Rf1 over all the width thereof. It is to be noted that the stoppers Rf1*a* may not have a structure as shown in FIG. 14*a*. For example, the stoppers may be mounted on a portion in the width-wise direction of the first reinforcement frame Rf1, and also the stoppers may be mounted outside of the first reinforcement frame Rf1. The stoppers are mounted on both the inner and outer surfaces of the first reinforcement frame Rf1. Furthermore, a stopper may be mounted on the first reinforcement frame Rf1, and another stopper may be mounted on the second reinforcement frame Rf2.

As shown in FIG. 14*b*, a stopper may be divided into two stoppers Rf1*b* and Rf2*b* in the width-wise direction of the strip F, wherein one stopper Rf1*b* is mounted on the first reinforcement frame Rf1 and another stopper Rf2*b* is mounted on the second reinforcement frame Rf2.

As shown in FIG. 14*c*, a stopper may be divided into three stoppers Rf1*c*, Rf1*c* and Rf2*c*, wherein two outside stoppers Rf1*c* and Rf1*c* are mounted on the first reinforcement frame Rf1 and another center stopper Rf2*c* is mounted on the second reinforcement frame Rf2.

In FIGS. 14*b* and 14*c*, only stoppers are shown, and the portions other than the stoppers are similar to that shown in FIG. 14*a*.

The reinforcement frames shown in FIGS. 14*b* and 14*c* have a more complicated structure than that shown in FIG. 14*a*, however, and have the following two functions.

(1) The reinforcement frame shown in FIG. 14*a* can not prevent the side portion of the first reinforcement frame from falling down inside thereof, however, the reinforcement frames shown in FIGS. 14*b* and 14*c* can prevent the first reinforcement frame from falling down inside thereof.

(2) The reinforcement frame shown in FIG. 14*a* can not prevent the second reinforcement frame from shifting in the width-wise direction of the strip F, however, the reinforcement frame shown in FIG. 14*b* can prevent it from shifting in one direction of the width-wise direction of the strip F, and the reinforcement frame shown in FIG. 14*c* can prevent it from shifting in both directions thereof.

Furthermore, the protective cover Pc can not only prevent the first reinforcement frame from falling down inside thereof but also prevent the second reinforcement frame from shifting in the width-wise direction.

FIGS. 15*a* and 15*b* show such a state that the first reinforcement frame Rf1 is mounted on the core C, wherein FIG. 15*a* is a whole view thereof and FIG. 15*b* is an enlarged view of the stopper Rf1*a*.

The first reinforcement frame Rf1 is mounted so that the vicinity of the opening portion thereof is installed within the step portions Ma2 and Ma2′ of the shaping tool Ma.

The first reinforcement frame Rf1 covers the portions other than the portions Ci1, Ci12 and Ci41 of the inner peripheral surface Ci of the core C. The second reinforcement frame Rf2 is mounted in the later process.

Thereafter, the protective cover Pc mounted thereon, which covers the core C so as to prevent the broken pieces of the strip F from leaving, and also ease a stress to be applied to the core C from the outside thereof.

The protective cover Pc is made of a kraft paper having a thickness in the range from one hundred and several tens μms to several hundreds μms. In the preferred embodiment, in order to mount the protective cover Pc on the core C efficiently and easily, an insulating sheet is cut and folded in a process for forming a local line-shaped dent in the shape of the core C in the previous process so as to form the protective cover Pc. Since the insulating sheet on a fold line is formed can be easily folded along the fold line in such a direction that the surface on which the line-shaped dent is formed is closed, the protective cover Pc can be easily formed.

As shown in FIG. 16, the protective cover Pc is comprised of a large cover Pc1 for covering the yoke portion C3 and the leg portions C2 and C4 of the core C, a small cover Pc2 for covering the yoke portion C1, and an L-shaped end portion cover Pc3 for locally covering the outer peripheral surface and the side surface of the core C along the end portion of the outer periphery of the core C over a portion between respective yoke portions C1 and C3 and the leg portions of both sides thereof.

There are provided one large cover Pc1, one small cover Pc2 and four end portion covers Pc3.

FIG. 16 shows a constructed state of the large cover Pc1 and the small cover Pc2 which are mounted on the core C. FIGS. 17 to 19 are developed views of the large cover Pc1, the small cover Pc2 and the end portion cover Pc3, respectively. FIG. 20 is a partial view of the end portion cover Pc3 which is mounted on the portion C3 of the core C.

In FIG. 17 to 19, each real line is cutting line, and each dotted line is a fold line.

The large cover Pc1 will be described below in i detail referring to FIG. 17. A surface 11 is used for covering the outer peripheral surfaces Ce2 and Ce4 of the leg portion of the core C, and a surface 12 is used for covering side surfaces Cs2, Cs23, Cs3, Cs34 and Cs4 positioned between the vicinity of the end portion of both the leg portions on the side of the yoke portion C1, and the yoke portion C3 thereof. A surface 13 is used for covering the outer peripheral surfaces Ce23, Ce3 and Ce34 positioned between the vicinity of the end portion of both the leg portions on the side of the yoke portion C3, and the yoke portion C3 thereof. Furthermore, a surface 14 is used for covering the inner peripheral surfaces Ci2 and Ci4 of the leg portions C2 and C4 of the core C.

Next, a standard dimension of respective portions of the protective cover Pc will be described below. In FIG. 17, a length X1 is set at a value equal to half the width of the stripe F or a slightly larger than that, and a length X2 is set at a value equal to a length between respective outer peripheral surfaces of both the leg portions of the core C. A length X3 is set at a value equal to the sum of a thickness of the leg portion of the core C and the thickness of the reinforcement frame Rf. A length X4 is expressed by the following equation, as is apparent from FIG. 17.

$$X4=(X2-2\cdot X3)/2$$

A length X5 is set at a value equal the sum of a small value required for mounting the large cover Pc1 on the core C added to a length along the outer peripheral surface of the core C in the portion positioned between the end portion of both the leg portions on the side of the yoke portion C3 of the core C, and the yoke portion C3 thereof.

Furthermore, a length Y1 is set at a value equal to a difference between the height of the window portion of the core C and respective rounded portions of the corner portions Ci12 (Ci41), and a length Y2 is set at a value equal to the sum of the thickness of the yoke portion C3 and the thickness of the reinforcement frame Rf. Furthermore, a length Y3 is set at a value equal to the width of the strip F, and a length Y4 is set at a value equal to about several tens mms.

A length Z1 of the fold line in the boundary area between the surfaces 12 and 13 is set at a value approximately equal to the length of the straight portion positioned along the peripheral direction of the core C of the outer peripheral surface Ce3 of the yoke portion in the center portion in the direction of the length X5. Furthermore, a base of the trapezoid on the surface 15 crosses an oblique line thereof at an angle of about 45 degrees. It is to be noted that each dent of the fold line is formed on the same surface of the large cover Pc1.

FIG. 18 shows the details of the small cover Pc2. In FIG. 18, a surface 21 of the small cover Pc2 is used for covering the side surfaces Cs1, Cs12 and Cs41 of the core C over a portion positioned between the vicinity of the end portion of both the leg portions on the side of the yoke portion C1 of the core C, and the yoke portion C1 thereof. A surface 22 thereof is used for covering the outer peripheral surfaces Ce1, Ce12 and Ce41 of the core C over a portion positioned between the vicinity of the end portion of both the leg portions on the side of the yoke portion C1 of the core C, and the yoke portion C1 thereof.

Next, standard dimensions of these lengths will be described below. A length X6 is expressed by the following equation, as is apparent from FIG. 18.

$$X6=X2-2\cdot X3$$

Furthermore, as is apparent from the comparison between FIGS. 17 and 18, the following equation is obtained.

$$X6=2\cdot X4$$

A length X7 is set at a value equal to the sum of a small value required for mounting the small cover Pc2 on the core C, added to a length along the outer peripheral surface of the core C in a portion between the end portion of both the leg portions on the side of the yoke portion C1 of the core C, and the yoke portion C1 thereof. A length Y5 is set at a value equal to the sum of a small value required for mounting the small cover Pc2 on the core C, added to the thickness of the yoke portion C1, and a length in the height direction of the window portion at the rounded portion of the corner portion Ci12 (Ci41). A length Y7 is expressed by the following equation, as is apparent from FIG. 18.

$$Y7 = Y5 - Y6$$

A length Z2 of the fold line in the boundary area between the surfaces 21 and 22 is set at a value approximately equal to a length of the straight line in the peripheral direction of the outer surface Ce1 in the center portion in the direction of the length X7. In this case, each dent of the fold line is formed on the same surface of the small cover Pc2.

FIG. 19 shows the end portion cover Pc3 for locally covering the outer peripheral surface and the side surface of the yoke portion C3 (C1) and the leg portion of both the end portions thereof, and the end portion covers Pc3 are mounted on the yoke portions C3 and C1.

In FIG. 19, a surface 31 is used for locally covering the outer peripheral surfaces of the vicinity of the end portion of both the leg portions of the core C and the yoke portion C3 (C1) thereof along the portions of the outer periphery of the core C. A surface 32 is used for locally covering the vicinity of the end portion of both the leg portions C2 and C4 of the core C and the side surface of the yoke portions C3 and C1 thereof. The surface 32 is further divided into small pieces 32*a*, 32*b* and 32*c* by cutting lines so as to easily fold the end portion cover along the corner portions of the core C. The piece 32*a* is used for covering the straight line portion of the side surface of the yoke portion C3 (C1), the piece 32*b* is used for covering the side surface of the corner portions positioned between the yoke portion C3 (C1) and the leg portions C2 and C4, and the piece 32*c* is used for covering the side surface of the end portion of the leg portions C2 and C4.

Lengths X8, X9, X10, Y8 and Y9 of the end portion cover are set as follows.

In the end portion cover mounted on the yoke portion C3, the length X8 is set at a value approximately equal to the length X5 or equal to the sum of a small value required for mounting the end portion cover thereon, added to the length X5. On the other hand, in the end portion cover mounted on the yoke portion C1, the length X8 is set at a value approximately equal to the length X7 or equal to the sum of a small value required for mounting the end portion cover thereon, added to the length X7.

In the end portion cover mounted on the yoke portion C3, the length X9 is set at a value approximately equal to a length in the peripheral direction of the straight line portion of the outer peripheral surface Ce3 of the yoke portion C3. On the other hand, in the end portion cover mounted on the yoke portion C1, the length X9 is set at a value approximately equal to a length of the straight line of the outer peripheral surface Ce1 of the yoke portion C1.

The length X10 is set at a value approximately equal to a length of the straight line portion of the leg portion of the core C and equal to or smaller than the length X8.

The length Y8 and Y9 are set at a value of about several tens mms, and the length Y8 is preferably larger than the length Y9.

Since the fold line is formed only in each center portion at the intersection portion (the end portion of the outer periphery of the core C) positioned between the side surface and the outer peripheral surface of the yoke portion on the large cover Pc1 and the small cover Pc2 and the cutting lines are formed in almost all the portions thereof, the broken pieces of the strip may be left outside thereof through the portions of the above cutting lines if only the large and small covers Pc1 and Pc2 are mounted thereon. In the preferred embodiment, in order to solve the above problem, the end portion cover Pc3 is mounted.

In respective portions of the core C, an outside force may be easily applied to the intersection portion between the side surface and the other peripheral surfaces of the yoke portion in the manufacturing process.

When the end portion cover Pc3 is mounted on the vicinity of the intersection portion between the side surface and the outer peripheral surface of the yoke portion with the large cover Pc1 or the small cover Pc2, not only the broken pieces of the strip F can be prevented from leaving through the above intersection portion but also a stress to be applied to the core C can be locally eased by the protective cover Pc.

After mounting the reinforcement frame Rf on the leg portions C2 and C4 and the yoke portion C3, the protective cover Pc is mounted on these portions C2, C4 and C3. As shown in FIG. 20, first of all, two end portion covers Pc3 and Pc3 are mounted so as to stride over the yoke portion C3 and the leg portions C2 and C4. Thereafter, as shown in FIG. 21, the large cover Pc1 for covering the yoke portion C3 and the leg portions C2 and C4 with the end portion covers Pc3 and Pc3 is mounted. The end portions of the large cover Pc1, the end portion of the large cover Pc1 and the core C, and the large cover Pc1 and the large reinforcement frame Rf1 are stuck and fixed in a predetermined shape using an adhesive tape or an adhesive agent, respectively.

The vicinity of both the left and right end portions of the lower portion of the surface 12 of the large cover Pc1 projects from the corners Ce23 and Ce24 of the outer peripheral surface of the core C. However, after cutting a projected portion as indicated by symbols Sb in FIG. 21, the projected portion is folded toward the sides of the outer peripheral surfaces Ce23 and Ce34 and stuck thereon using an adhesive tape.

As shown in the present preferred embodiment, when the large cover Pc1 is made of an insulating sheet, the width of the surface 14 of the large cover Pc1 becomes the difference between the width of the window portion of the core C and twice the thickness of the reinforcement frame Rf1. Therefore, if the width of the strip F is larger than the difference between the width of the window portion of the core C and twice the thickness of the reinforcement frame Rf1, the center portion of the leg portions C2 and C4 in the depth-wise direction is not closed by the surfaces 14 and 14 upon mounting the large cover Pc1 on the core C, a gap is extending in the height-wise direction of the window portion of the core C is produced, and the reinforcement frame Rf1 is exposed to the outside thereof.

However, since the inner peripheral surface of the core C is covered by the reinforcement frame and any outside force is hardly applied to the gap portion even though the above gap is formed, the broken pieces of the strip F can be prevented from leaving there to the outside thereof, and an outside force to be applied to the core C can be eased by the protective cover.

As shown in FIG. 16, on the surface 14 of the large cover Pc1, the width of the strip F is the difference between the width of the window portion of the core C and twice the thickness of the reinforcement frame Rf1. In this state, respective end surfaces of the surface 14 connected to one surface 12 and the surface 14 connected to another surface 12 are not overlapped and are apart with each other, and they are in contact with each other. Then, mounting of the large cover Pc1 for covering the yoke portion C3 and the leg portions C2 and C4 is completed.

A pair of large cover Pc1 and end portion cover Pc3 is called a first protective cover portion. Furthermore, the end portion cover included in the first protective cover portion is called a first end portion cover.

FIG. 22 shows a state after mounting the first protective cover portion as described above and detaching the members (the shaping tool Ma and the pressing part K1) which clamp the yoke portion C1. In FIG. 22, the indications of the thickness of the protective cover are omitted. Therefore, the indication of the end portion cover Pc3 is omitted in the partial broken view shown in FIG. 22.

In the preferred embodiment, since the joint portion is fixed by the shaping tool Ma for a period from a timing when the lamination block is wound to a timing when mounting of the first protective cover is completed, the core C can be prevented from being deformed and the strip F can be prevented from being damaged upon working.

Thereafter, after the joint portion of the portion C1 is opened once, the windings are fitted around the leg portions C2 and C4 of the core C. In the preferred embodiment, two guiding jigs G shown in FIG. 23 are used as a jig for preventing the joint portion of the strip F from being damaged and also for improving the efficiency of the working. The guiding jig G is comprised of one base plate G1 and two side plates G2 and G2, wherein the end portion of the side plate G2 on the side of the base plate G1 is spot-welded on the base plate G1 so that the side surface of the side plate G2 is in contact with the center portion in the length-wise direction of the base plate G1, and the flat plate portions Ga and Gb project from both ends of a channel portion Gc comprised of the center portion of the base plate G1 and the side plates G2 and G2.

The width of the flat plate portions Ga and Gb of the guiding jig G is equal to the inner length between the side plates G2 and G2 of the channel portion Gc, and this length is set at a value equal to the sum of the thickness of the leg portion of the core C under the condition that the reinforcement frame Rf1 and the protective cover Pc are mounted on the leg portion of the core C and a small margin value.

The length of the channel portion Gc of the guiding jig G is set at a value approximately equal to the difference of the height of the window portion of the core C and the length in the up and down directions of the rounded portion of the top and bottom portions thereof. Furthermore, the height of the side plate G2 of the channel portion Gc of the guiding jig G from the base plate thereof is set at a value approximately equal to the width of the strip F.

The lengths of the flat plate portions Ga and Gb of the guiding jig G are set at a value so that the strip F of the joint portion which is opened from the end portion of the flat plate portion Ga does not project in a process shown in FIG. 25 and described later and so that the end portion of the flat plate portion Gb is positioned in the vicinity of the bottom end portion of the leg portion of the core C in a process shown in FIG. 27.

First of all, the channel portion Gc of the guiding jig G is mounted on the leg portions C2 and C4 of the core C. The guiding jig G is mounted in such a state that the flat plate portion Ga is positioned on the yoke portion C1 of the core C, and the flat plate portion Gb is positioned on the yoke portion C3. (See FIG. 24). Since the indication of the thickness of the protective cover is omitted in FIGS. 24 to 29, the indication of the end portion cover is omitted in the partial broken view thereof.

After mounting the guiding jig G as described above, the joint portion is opened sequentially order from the outside of the lamination block toward the inside thereof so that the core C has a U-shape. Then, the joint portion thereof is positioned on the portion Ga of the guiding jig G. (See FIG. 25.)

It is to be noted that the opened joint portion does not have a straight line shape as shown in FIG. 25, and is apt to fall down inside thereof so as to approach with each other.

FIG. 26 is an enlarged partial view of the lamination blocks B1 to B3 under the condition that the opened joint portion has the same straight line shape as that of the leg portion.

In FIGS. 25 and 27 to 29, a chain line of the opened end of the core C denotes an envelope showing the lamination units projecting into the opening end of the core C in FIG. 26. The core C is slid in the direction of the flat plate portion Gb of the guiding jig G so that the joint portion opened as shown in FIG. 27 is positioned within the channel portion Gc of the guiding jig G.

After arranging the windings W (not shown in FIG. 27) in front of the flat plate Ga of the guiding jig G (on the opposite side of the channel portion Gc), the windings W are fixed under the condition that the axis of the windings coincides to that of the leg portion of the core C.

Thereafter, the core C and the guiding jig G are moved as one body so as to press out toward the windings W. Then, the flat plate portion Ga of the guiding jig G passes through the window portion of the windings W, the channel portion Gc passes through the window portion of the windings W, and finally, the flat plate portion Gb is positioned within the window portion of the windings W. Then, the windings W are fitted around the leg portions C2 and C4 of the core C as shown in FIG. 28.

Thereafter, after the second reinforcement frame Rf2 is made face the first reinforcement frame Rf1 which is mounted previously, the first reinforcement frame Rf1 is mounted so that the stopper Rf1*a* is positioned inside of the second reinforcement frame Rf2. Then, the lamination blocks are jointed in order from the inside to the outside thereof in the opposite direction of the case that the joint portion is opened. Namely, the left and right end portions of each lamination block are folded in the order of the lamination blocks B1, B2, ... so as to approach with each other, and the opening portion of the core C is closed so as to form a joint portion. This working for closing the core C again is performed with drawing out the guiding jig G gradually. For example, when the lamination block B10 is being jointed, the lamination blocks B11, B12, ... are positioned within the guiding jig Gc so as to be fixed. Thus, since the lamination blocks to be jointed later are not covered, the lamination block which is being jointed, the working can be performed easily, and also the strip F can be prevented from being damaged. As described above, the yoke portion C is closed so as to reform the joint portion.

After the reformation of the joint portion is completed, an adhesive tape is stuck on the joint portion of the lamination units so that it is fixed temporarily, and then, the guiding jig G is drawn out.

Taking only the protection of the strip F upon working into consideration, even through a jig comprised of only the channel portion Gc may be used as the guiding jig G, the above object can be achieved .

However, as described in the preferred embodiment, when the guiding jig G comprised of the channel portion Gc and the flat plate portions Ga and Gb is used, the guiding jig G can be moved using the flat plate portions Ga and Gb as a handle. Therefore, the working for performing the above process is performed efficiency. Since the bottom surface of the core C is in contact with the guiding jig G, the relative movement between the core C and the guiding jig G in the lengthwise direction can be performed smoothly under the condition that the core C is arranged on the guiding jig G.

Upon closing the yoke portion C1, an adhesive agent such as epoxy resin may be applied partially to the side surface of the joint portion.

After drawing out the guiding jig G, the small cover Pc2 and the end portion cover Pc3 are mounted on the yoke portion C1 and the higher portions of the leg portions C2 and C4. First of all, two end portion covers Pc3 are mounted along the end portion of the outer periphery of the core C so as to cover the higher portion of the leg portion C2, the yoke portion C1, and the higher portion of the leg portion C4 in the same manner as the case that the end portion cover Pc3 is mounted so as to cover the lower portion of the leg portion C2, the yoke portion C3, and the lower portion of the leg portion C4 previously.

Thereafter, the small cover Pc2 is mounted outside of the end portion cover Pc3 so as to cover the higher portion of the leg portion C2, the yoke portion C1, and the higher portion of the leg portion C4. Since the inner peripheral surface Ci1 of the yoke portion C1 is covered by the second reinforcement frame Rf2 which has been mounted already, the small cover Pc2 is mounted on the second reinforcement frame so as to wholly cover the core C. Since the leg portion C2, the yoke portion C3, and the leg portion C4 of the core C have been covered by the large cover Pc1, the small cover Pc2 is mounted so as to be overlapped on the end portion of the large cover Pc1 on the yoke portion C1.

A portion positioned between both the end portions of the small cover Pc2, and a portion positioned between the end portion of the small cover Pc2 and the large cover Pc1 are stuck using an adhesive tape or an adhesive agent so as to fix the end portions of the small cover Pc2. Since the vicinity of both the left and right end portions of the surface 21 of the small cover Pc2 projects from the corner portions Ce12 and Ce41 of the outer peripheral surface of the core C, the projected portions thereof are processed in the same manner as that in which the projected portion of the large cover Pc1 is processed. Then, mounting of the protective cover Pc is completed.

An assembled body comprised of the small cover Pc2 and the end portion cover Pc3 mounted on the portion C1 of the core C is called a second protective cover portion hereinafter. Furthermore, the end portion cover included in the second protective cover portion is called a first end portion cover hereinafter.

Thereafter, a reinforcement band Rf is mounted, which is used for holding the outer peripheral shape of the core C and also protecting and reinforcing the core C from the side of the outer periphery thereof so as not to break up the joint portion of the lamination block. In the preferred embodiment, the reinforcement band is made of an iron plate having a thickness of about several hundreds μms, and the width thereof is set at a value approximately equal to or slightly smaller than the width of the strip F. The reinforcement band Rb is wound around the outer peripheral surface of the core C which is covered by the protective cover Pc. Since the windings W are fitted around the leg portions of the core C, the reinforcement band Rb is passed through the window portion of the windings W so as to insert one end of the reinforcement band Rb between the window portion of the core C and the outer peripheral surface of the protective cover Pc wound around the core C. Both ends of the reinforcement band Rb, which is wound from the outside of the protective cover Pc for covering the core C to the outer periphery of the core C are overlapped with each other on the portion C1 of the core C, and then, the joint portion is spot-welded so as to be fixed thereon.

Upon clamping the reinforcement band Rb, a force is applied thereto in the inside direction thereof. However, since the protective cover Pc is arranged between the strips F, a stress to be applied to the strips F is eased, and the strips F can be prevented from being damaged.

Thus, the complete core Cc comprised of the core C, and the reinforcement frame Rf, the protective cover Pc and the reinforcement band Rb is built as shown in FIG. 1. The windings W are fitted around the complete core Cc so as to form the main body of the transformer. In FIG. 1, Rbj denotes a spot-welding portion of the reinforcement band Rb.

In FIG. 1, the protective cover Pc for the complete core Cc is shown as one body, and also the overlapping portion between the large cover Pc1 and the end portion cover Pc3, the overlapping portion between the small cover Pc2 and the end portion cover Pc3, and the overlapping portion between the large cover Pc1 and the small cover Pc2 are drawn without taking the actual increase of the thickness thereof into consideration.

In the manufacturing process of the transformer, the joint surface of the core C may be positioned at a higher position thereof, and also the core C may fall down sideways so that the side surface thereof becomes horizontal. However, upon positioning the transformer at a predetermined position after completing the transformer, the transformer is preferably arranged so that the joint portion thereof is positioned at a lower portion and the side surface thereof is positioned in parallel to the vertical direction. When an abnormal shock is received by the transformer upon transporting or operating the transformer, the joint portion may be loosen. However, when the joint portion is positioned at a lower portion thereof, the joint portion can be prevented from being loosen. Furthermore, since the adhesive agent is applied to the side surface of the joint portion as described above, the joint portion can be effectively prevented from being loosen.

As shown in FIG. 30, the protective sheet Ps is mounted on the inner peripheral surface of the core C upon winding the lamination blocks, the strip F can be effectively prevented from being damaged. The protective sheet Ps is preferably made of a stainless steel sheet having a thickness of about several tens μms. However, a sheet made of a high thermal-proof organic insulating material such as polyimide resin which is proof against annealing can be used as the material of the above protective sheet Ps. The width of the protective sheet Ps is set at a value approximately equal to the width of the strip F.

In this case, first of all, the protective sheet Ps is mounted around the bobbin M, and then, both ends thereof are overlapped on the flat surface Ma1 of the bobbin M. The lamination block B is wound in the same manner as that described above. FIG. 30 shows a state that the lamination block B has been completely wound using the protective sheet Ps. It is to be noted that the decrease of the overlapping dimension of the strips F becomes very small such as about several hundreds μms when using the protective sheet Ps since it is extremely thin. In this case, the working for shaping the core C is performed in the same manner as that described above.

FIG. 31 shows the core C before the first reinforcement frame Rf1 is mounted thereon in a preferred embodiment in which the protective sheet Ps is mounted around the inner periphery of the core C. In this case, the reinforcement frame Rf is mounted inside of the protective sheet Ps. Since the protective sheet Ps is mounted around the inner peripheral surface of the core C, the strip F of the inner periphery of the core C can be prevented from being damaged, upon detaching the rectangular shaping tool, upon mounting the reinforcement frame, upon opening the joint portion, and upon closing the joint portion again.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A stationary induction electric apparatus, wherein plural lamination blocks are formed respectively by laminating plural lamination units, each of which is formed by laminating a predetermined number of cut strips of an amorphous magnetic alloy, said plural lamination blocks are built up into a substantially rectangular wound core by piling them up and by jointing respective ends of individual lamination units of each lamination block in an overlapped state so as to position the joint portion thereof on one side of the rectangular wound core, one side having the joint portion and another opposing side are made as yoke portions respectively, and both two sides positioned between the yoke portions are made as leg portions respectively, said apparatus comprising:

a protective sheet of a thermal-proof insulating material mounted inside of the innermost lamination block of said rectangular core, said protective sheet having substantially the same width as that of said strips;

a reinforcement frame mounted on the surface of said protective sheet;

a protective cover covering both said rectangular core and said reinforcement frame with substantially no space between said protective cover and said rectangular core, said protective cover being made of an electrically insulating paper;

a reinforcement band wound with substantially no space between said reinforcement band and said protective cover around the outer peripheral surface of said rectangular core on which said protective cover is fixedly mounted; and windings fitted around the leg portions of said rectangular core on which said reinforcement frame, said protective cover and said reinforcement band are mounted.

2. The apparatus as claimed in claim 1, wherein said protective cover comprises:

a first L-shaped end portion cover for covering the outer peripheral surface and the side surface in the vicinity of the end portion of the outer periphery of said rectangular core, said end portion cover arranged so as to stride over the yoke portion not having the joint portion of said rectangular core and both the leg portions thereof;

a large cover to be mounted so as to cover the yoke portion not having the joint portion and both the leg portions together with said first end portion cover;

a second L-shaped end portion cover for covering the outer peripheral surface and the side surface in the vicinity of the end portion of the outer periphery of said rectangular core, said second end portion cover arranged so as to stride over the yoke portion having the joint portion and both the leg portions thereof; and a small cover to be mounted so as to cover the yoke portion having the joint portion together with said second end portion cover.

3. The apparatus as claimed in claim 2, wherein said first and second end portion covers, said large cover and said small cover are made of insulating sheets having a predetermined shape and predetermined dimension, respectively, on which a fold line is formed at a portion which becomes a peak portion upon folding the insulating sheet; and respective insulating sheets thereof are folded along the fold lines so as to form said first and second end portion covers, said large cover, and said small cover, respectively.

* * * * *